US007413274B2

(12) United States Patent
Usui

(10) Patent No.: US 7,413,274 B2
(45) Date of Patent: Aug. 19, 2008

(54) PRINTING METHOD, PRINTING APPARATUS, AND HEAD UNIT

(75) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 94 days.

(21) Appl. No.: 11/606,955

(22) Filed: Dec. 1, 2006

(65) Prior Publication Data

US 2007/0126769 A1 Jun. 7, 2007

(30) Foreign Application Priority Data

Dec. 1, 2005 (JP) ..... 2005-347780

(51) Int. Cl.
*B41J 2/205* (2006.01)

(52) U.S. Cl. ..... 347/15; 347/43

(58) Field of Classification Search ..... 347/15, 347/43

See application file for complete search history.

(56) References Cited

U.S. PATENT DOCUMENTS 5,889,538 A * 3/1999 Kishimoto et al. ..... 347/43

6,024,438 A * 2/2000 Koike et al. ..... 347/43

FOREIGN PATENT DOCUMENTS

JP 9-011457 A 1/1997

* cited by examiner

*Primary Examiner*—Thinh H Nguyen
(74) *Attorney, Agent, or Firm*—Sughrue Mion, PLLC

(57) ABSTRACT

A printing method includes: preparing a drive element that corresponds to a nozzle, and a controller that drives the drive element so as to eject a liquid droplet from the nozzle, the controller having a first input section and a second input section; in the case of printing with a first number of gradations, driving the drive element based on a first signal and a second signal, by inputting the first signal to the first input section and inputting the second signal to the second input section; and in the case of printing with a second number of gradations that is lower than the first number of gradations, driving the drive element based on a first signal, by inputting the first signal to the first input section and inputting a signal of a constant potential to the second input section.

20 Claims, 30 Drawing Sheets

| pixel data | applied pulse | size of ink droplet |
|---|---|---|
| 00 | PS11 | 0(fine vibration) |
| 01 | PS13 | 3pl |
| 10 | PS12 | 7pl |
| 11 | PS12+PS14 | 14pl |

FIG. 17A

| pixel data | applied pulse | size of ink droplet |
|---|---|---|
| 000 | PS11 | 0(fine vibration) |
| 001 | PS15 | 1. 5pl |
| 010 | PS13 | 3 |
| 011 | PS13+PS15 | 4. 5 |
| 100 | PS12 | 7 |
| 101 | PS14+PS15 | 8. 5 |
| 110 | PS12+PS13 | 10 |
| 111 | PS12+PS14 | 14 |

FIG. 17B

| before decoding | | after decoding | |
|---|---|---|---|
| 000 | → | 000 | (fine vibration) |
| 001 | → | 100 | |
| 010 | → | 001 | (3pl) |
| 011 | → | 101 | |
| 100 | → | 010 | (7pl) |
| 101 | → | 110 | |
| 110 | → | 111 | |
| 111 | → | 011 | (14pl) |

FIG. 18

| before decoding | | after decoding | |
|---|---|---|---|
| 000 | → | 000 | (fine vibration) |
| 001 | → | 100 | |
| 010 | → | 001 | (3pl) |
| 011 | → | 010 | (7pl) |
| 100 | → | 101 | |
| 101 | → | 011 | (14pl) |

FIG. 22

| before decoding | | after decoding | |
|---|---|---|---|
| 000 | → | 000 | (fine vibration) |
| 001 | → | 100 | |
| 010 | → | 001 | (3pl) |
| 011 | → | 010 | (7pl) |
| 100 | → | 011 | (14pl) |
| 101 | → | 101 | |

FIG. 26

| pixel data | first switch signal SW_A | second switch signal SW_B |
|---|---|---|
| 000 | q0 | q6 |
| 001 | q1 | q7 |
| 010 | q2 | q8 |
| 011 | q3 | q9 |
| 100 | q4 | q10 |
| 101 | q5 | q11 |

FIG. 29

PRINTING METHOD, PRINTING APPARATUS, AND HEAD UNIT

CROSS-REFERENCE TO RELATED APPLICATIONS

The present application claims priority upon Japanese Patent Application No. 2005-347780 filed on Dec. 1, 2005, which is herein incorporated by reference.

BACKGROUND

1. Technical Field

The present invention relates to printing methods, printing apparatuses, and head units.

2. Related Art

Inkjet printers are known as one example of printing apparatuses that eject droplets of liquid. Inkjet printers form dots on paper by ejecting ink droplets from nozzles, thereby printing print images that are made of many dots on the paper.

In the head unit for ejecting ink droplets, a drive element such as a piezo element or a heater is provided for each nozzle in order to effect the ejection of an ink droplet from the nozzle. The head unit is also provided with a head controller for controlling the driving of the drive elements (see JP-A-9-11457).

There is a demand for printing in which the number of gradations is changed for each color of ink. For example, there is a demand for printing in which cyan and magenta are printed in six gradations, but in which yellow is printed in four gradations.

In such a case, there is the problem that it is costly to provide head controllers with different structures for each color.

SUMMARY

It is an object of the invention to enable printing with different numbers of gradations using a head controller that has a common structure.

A main aspect of the invention for achieving the foregoing object is a printing method including:

preparing a drive element that corresponds to a nozzle, and a controller that drives the drive element so as to eject a liquid droplet from the nozzle, the controller having a first input section and a second input section;

in the case of printing with a first number of gradations, driving the drive element based on a first signal and a second signal, by inputting the first signal to the first input section and inputting the second signal to the second input section; and in the case of printing with a second number of gradations that is lower than the first number of gradations, driving the drive element based on a first signal, by inputting the first signal to the first input section and inputting a signal of a constant potential to the second input section.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings.

FIG. 17A is a table for explaining the relationship between the pixel data and the ink droplet size at the time of four gradation printing, and FIG. 17B is a table for explaining the relationship between the pixel data and the ink droplet size at the time of eight gradation printing.

FIG. 18 is an explanatory diagram of the decoding of the pixel data in eight gradation printing.

FIG. 22 is an explanatory diagram of the decoding of the pixel data in six gradation printing.

FIG. 26 is an explanatory diagram of the decoding of the pixel data in six gradation printing.

FIG. 29 is a table of the relationship between the 3-bit pixel data and the selection signal that should be selected by the signal selection section.

DESCRIPTION OF EXEMPLARY EMBODIMENTS

Figure 1:
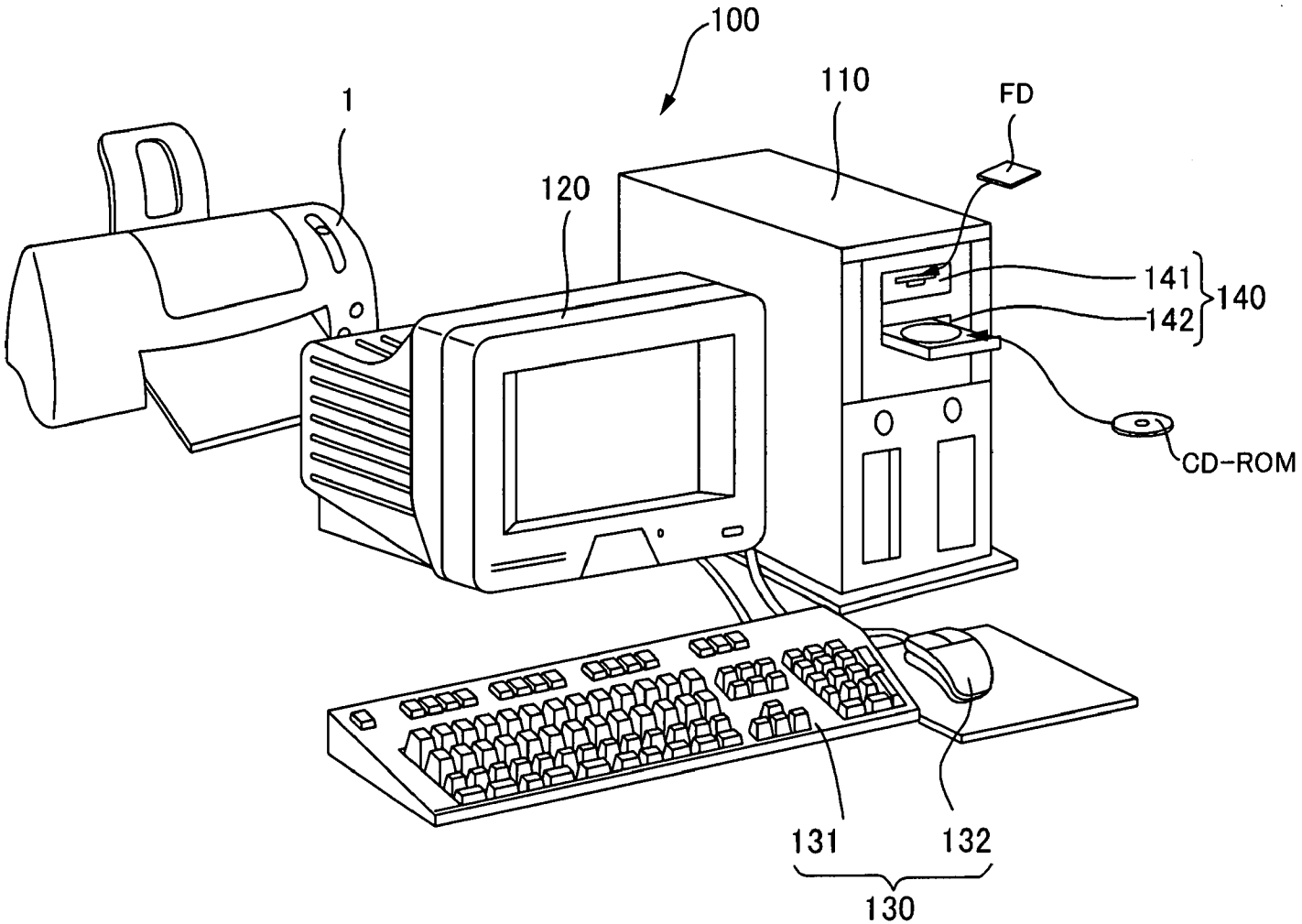
FIG. 1 is a diagram explaining the configuration of the printing system 100.

At least the following matters will become clear through the description of the present specification and the accompanying drawings.

A printing method comprising:

preparing a drive element that corresponds to a nozzle, and a controller that drives the drive element so as to eject a liquid droplet from the nozzle, the controller having a first input section and a second input section;

in the case of printing with a first number of gradations, driving the drive element based on a first signal and a second signal, by inputting the first signal to the first input section and inputting the second signal to the second input section; and in the case of printing with a second number of gradations that is lower than the first number of gradations, driving the drive element based on a first signal, by inputting the first signal to the first input section and inputting a signal of a constant potential to the second input section.

According to such a printing method, printing with different gradations using a controller with a common structure is possible.

A printing method is preferable, wherein pixel data that corresponds to a pixel is included in the first signal and the second signal, wherein in the case of printing with the first number of gradations, the controller drives the drive element, based on the pixel data included in the first signal and the pixel data included in the second signal, and wherein in the case of printing with the second number of gradations, the controller drives the drive element, based on the pixel data included in the first signal and data that has been set according to the signal of the constant potential.

Thus, using a controller with a common structure, printing can be performed with the pixel data for a high gradation, and printing can be performed with the pixel data for a low gradation.

A printing method is preferable, wherein in the case of printing with the first number of gradations, the controller drives the drive element, based on i+j bit of pixel data formed of i bit of the pixel data included in the first signal and j bit of the pixel data included in the second signal, and wherein in the case of printing with the second number of gradations, the controller drives the drive element, based on i+j bit of pixel data formed of i bit of the pixel data included in the first signal and j bit of data that has been set at a specific value according to the signal at the constant potential.

Thus, even if the head unit performs the same operation regardless of the number of gradations, when a signal of a constant potential is input to the second input portion, printing with the second number of gradations is performed.

A printing method is preferable, wherein the controller includes a first pixel data storage section that stores the pixel data included in the first signal, and a second pixel data storage section that stores the pixel data included in the second signal, and wherein the controller drives the drive element, based on the pixel data stored in the first pixel data storage section and the pixel data stored in the second pixel data storage section.

A printing method is desirable, wherein when the signal of the constant potential is input to the second input section, the pixel data to be stored in the second pixel data storage section becomes a specific value.

Thus, even if the head unit performs the same operation regardless of the number of gradations, when a signal of a constant potential is input to the second input portion, printing with the second number of gradations is performed.

A printing method is preferable, wherein the controller has a switch that controls whether or not to apply a drive signal to the drive element, wherein setting data for setting control of the switch is included in the first signal and the second signal, and wherein in the case of printing with the first number of gradations, the controller controls the switch, based on the setting data included in the first signal and the setting data included in the second signal, and wherein in the case of printing with the second number of gradations, the controller controls the switch, based on the setting data included in the first signal.

Thus, using a controller with a common structure, printing can be performed with the setting data for a high gradation, and printing can be performed with the setting data for a low gradation.

A printing method is preferable, wherein the controller has a selection signal creation section that creates a plurality of selection signals, wherein in the case of printing with the first number of gradations, the controller controls the switch based on a selection signal that has been selected according to the pixel data included in the first signal and the pixel data included in the second signal, from among a plurality of the selection signals, and wherein in the case of printing with the second number of gradations, the controller controls the switch based on a selection signal that has been selected according to the pixel data included in the first signal and data that has been set according to the signal of the constant potential, from among a plurality of the selection signals.

Thus, even if the head unit performs the same operation regardless of the number of gradations, when a signal of a constant potential is input to the second input portion, printing with the second number of gradations is performed.

A printing method is preferable, wherein the controller has a switch that controls whether or not to apply a drive signal to the drive element, wherein setting data for setting control of the switch is included in the first signal and the second signal, wherein in the case of printing with the first number of gradations, the controller controls the switch, based on the setting data included in the first signal and the setting data included in the second signal, and wherein in the case of printing with the second number of gradations, the controller controls the switch, based on the setting data included in the first signal.

Thus, using a controller with a common structure, printing can be performed with the setting data for a high gradation, and printing can be performed with the setting data for a low gradation.

A printing method is preferable, wherein in the case of printing with the second number of gradations, the controller controls the switch, based on the setting data included in the first signal and data that has been set according to the signal of the constant potential.

Thus, using a controller with a common structure, printing can be performed with the setting data for a high gradation, and printing can be performed with the setting data for a low gradation.

A printing method is preferable, wherein the controller has a first setting data storage section that stores the setting data included in the first signal, and a second setting data storage section that stores the setting data included in the second signal, and wherein the controller controls the switch, based on the setting data that is stored in the first setting data storage section and the setting data that is stored in the second setting data storage section.

Thus, data amount of the setting data to be input to the first input portion can be decreased.

A printing method according is desirable, wherein when the signal of the constant potential is input to the second input portion, the setting data that is to be stored in the second setting data storage section becomes a specific value.

Thus, even if the head unit performs the same operation regardless of the number of gradations, when a signal of a constant potential is input to the second input portion, printing with the second number of gradations is performed.

A printing method is preferable, wherein the controller has a selection signal creation section that creates a plurality of selection signals based on the setting data, and controls the switch based on the selection signal that has been selected from a plurality of the selection signals.

A printing method is desirable, wherein in the case of printing with the second number of gradations, a selection signal that has been created based on data that has been set according to the signal of the constant potential is not selected.

Thus, even if the head unit performs the same operation regardless of the number of gradations, when a signal of a constant potential is input to the second input portion, printing with the second number of gradations is performed.

A printing method is preferable, wherein the pixel data that corresponds to a pixel is included in the first signal and the second signal, wherein in the case of printing with the first number of gradations, the controller controls the switch based on the selection signal that has been selected according to the pixel data included in the first signal and the pixel data included in the second signal, and wherein in the case of printing with the second number of gradations, the controller controls the switch based on the selected signal that has been selected according to the pixel data included in the first signal and data that has been set according to the signal of the constant potential.

Thus, even if the head unit performs the same operation regardless of the number of gradations, when a signal of a constant potential is input to the second input portion, printing with the second number of gradations is performed.

A printing method is preferable, wherein the drive signal is a signal that is repeated in a predetermined period, wherein a plurality of drive pulses for driving the drive element are included in the predetermined period of the drive signal, and wherein the setting data is data for determining whether or not to apply each drive pulse to the drive element.

A printing method is desirable, wherein the controller applies to the drive element the drive pulses included in any drive signal of a plurality of types of drive signals, and wherein the setting data is data for determining whether or not to apply each drive pulse of each drive signal to the drive element.

In such a case it is especially effective.

A printing method is preferable, wherein while the drive element is being driven during a certain period, a signal necessary for driving the drive element in the next period is input to the first input section and the second input section. In such a case, it is especially effective.

A printing method is preferable, wherein the second input section is connected to the GND. In this way, it becomes easy to input a signal of a constant potential to a second input section.

A printing apparatus comprising:

a drive element that corresponds to a nozzle;

a first controller that drives the drive element so as to eject a liquid droplet from the nozzle; and a second controller that drives the drive element so as to eject a liquid droplet from the nozzle, wherein the first controller and the second controller have a first input section and a second input section, respectively, wherein with the first controller that prints with a first number of gradations, a first signal is input to the first input section and a second signal is input to the second input section, and the drive element is driven based on the first signal and the second signal, and wherein with the second controller that prints with a second number of gradations that is lower than the first number of gradations, the first signal is input to the first input section and a signal of a constant potential is input to the second input section, and the drive element is driven based on the first signal.

According to such a printing apparatus, the structures of the first controller and the second controller that perform printing with different gradations, can be made common.

A head unit comprising:

a drive element that corresponds to a nozzle; and a controller that drives the drive element so as to eject a liquid droplet from the nozzle, wherein the controller has a first input section and a second input section, wherein in the case of printing with a first number of gradations, a first signal is input to the first input section and a second signal is input to the second input section, and the drive element is driven based on the first signal and the second signal, and wherein in the case of printing with a second number of gradations that is lower than the first number of gradations, a first signal is input to the first input section and a signal of a constant potential is input to the second input section, and the drive element is driven based on the first signal.

According to such a head unit, printing with different gradations is possible using a controller with a common structure.

Configuration of the Printing System

Regarding the Overall Configuration

FIG. 1 is a diagram that explains the configuration of a printing system 100. The printing system 100 of this example includes a printer 1 as a printing apparatus and a computer 110 as a print control apparatus. Specifically, the printing system 100 has the printer 1, the computer 110, a display device 120, an input device 130, and a recording and reproducing device 140.

The printer 1 prints images on media such as paper, cloth, and film. The computer 110 is communicably connected to the printer 1. To print images with the printer 1, the computer 110 outputs print data that correspond to the image to the printer 1. Computer programs such as an application program and a printer driver are installed on the computer 110. The display device 120 has a display. The display device 120 is a device for displaying a user interface of the computer programs, for example. The input device 130 is, for example, a keyboard 131 and a mouse 132. The recording and reproducing device 140 is, for example, a flexible disk drive device 141 and a CD-ROM drive device 142.

Computer

Figure 2:
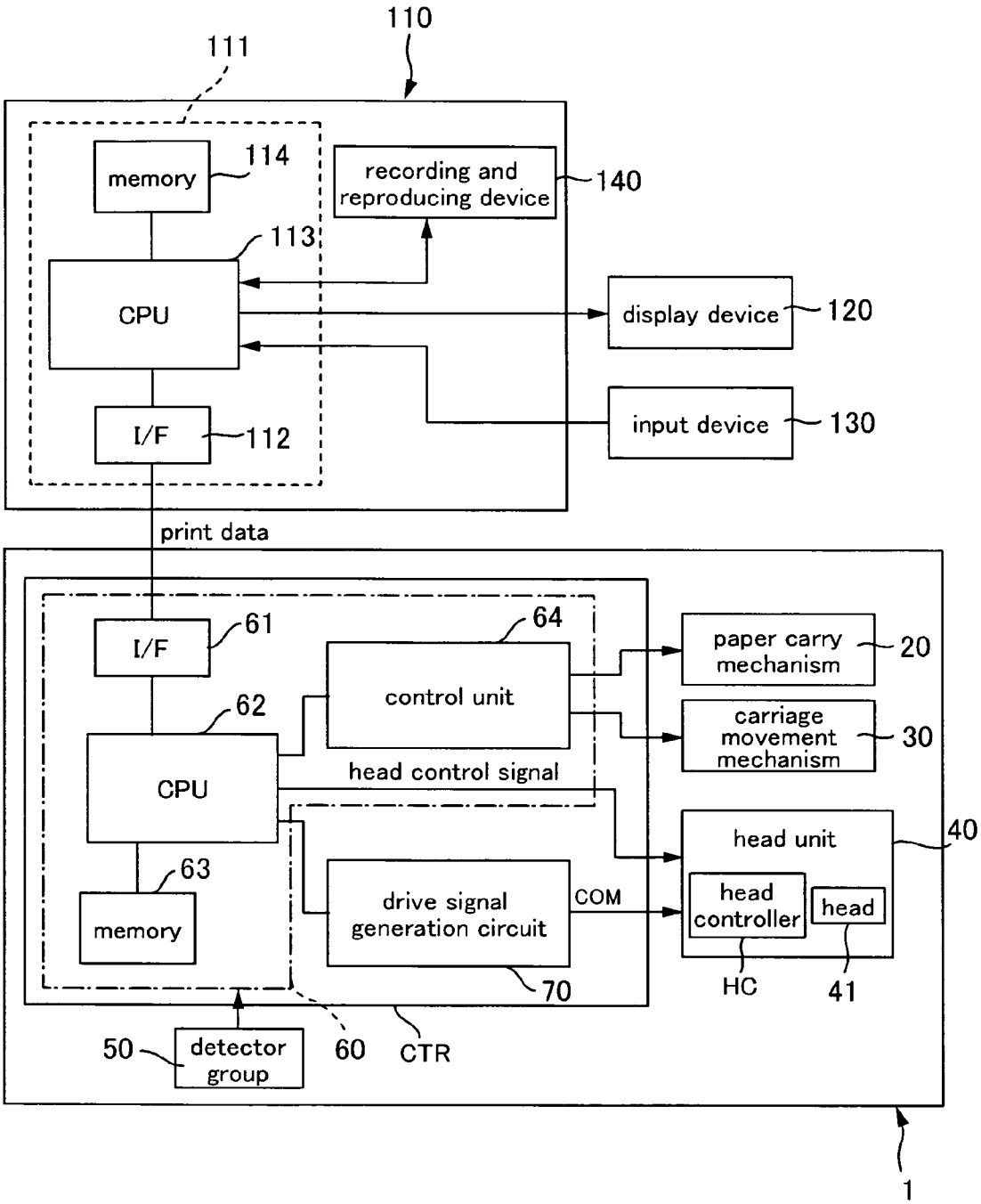
FIG. 2 is a block diagram explaining the configuration of the computer 110 and the printer 1.

FIG. 2 is a block diagram for explaining the configuration of the computer 110 and the printer 1. First, the configuration of the computer 110 is described in brief. The computer 110 has the recording and reproducing device 140 described above and a host-side controller 111. The recording and reproducing device 140 is communicably connected to the host-side controller 111, and for example is attached to the housing of the computer 110. The host-side controller 111 performs various controls in the computer 110, and is also communicably connected to the display device 120 and the input device 130 mentioned above. The host-side controller 111 has an interface section 112, a CPU 113, and a memory 114. The interface section 112 is interposed between the computer 110 and the printer 1, and sends and receives data between the two. The CPU 113 is a computation processing device for performing overall control of the computer 110. The memory 114 is for securing a working region and a region for storing computer programs used by the CPU 113, and is constituted by a RAM, EEPROM, ROM, or magnetic disk device, for example. Examples of computer programs that are stored on the memory 114 include the application program and the printer driver mentioned above. The CPU 113 performs various controls in accordance with the computer programs stored on the memory 114.

The printer driver causes the computer 110 to convert the image data into print data and sends these print data to the printer 1. The print data are data in a form that can be understood by the printer 1, and include various command data and pixel data. Command data are data for ordering the printer 1 to execute a specific operation. Examples of the command data include command data for directing the feeding of paper, command data for indicating the carry amount, and command data for directing the discharge of paper. The pixel data are data relating to the pixels of the image to be printed.

Here, a pixel refers to a unit pixel that is part of an image, and images are formed by arranging pixels in rows in two dimensions. The pixel data of the print data are data relating to the dots that are formed on the paper S (for example, they are gradation values).

In this embodiments, the pixel data are two bits or three bits of data per pixel. 2-bit pixel data can express a single pixel in four gradations. 3-bit pixel data can express a single pixel in eight gradations.

Printer

Regarding the Configuration of the Printer 1

Figure 3:
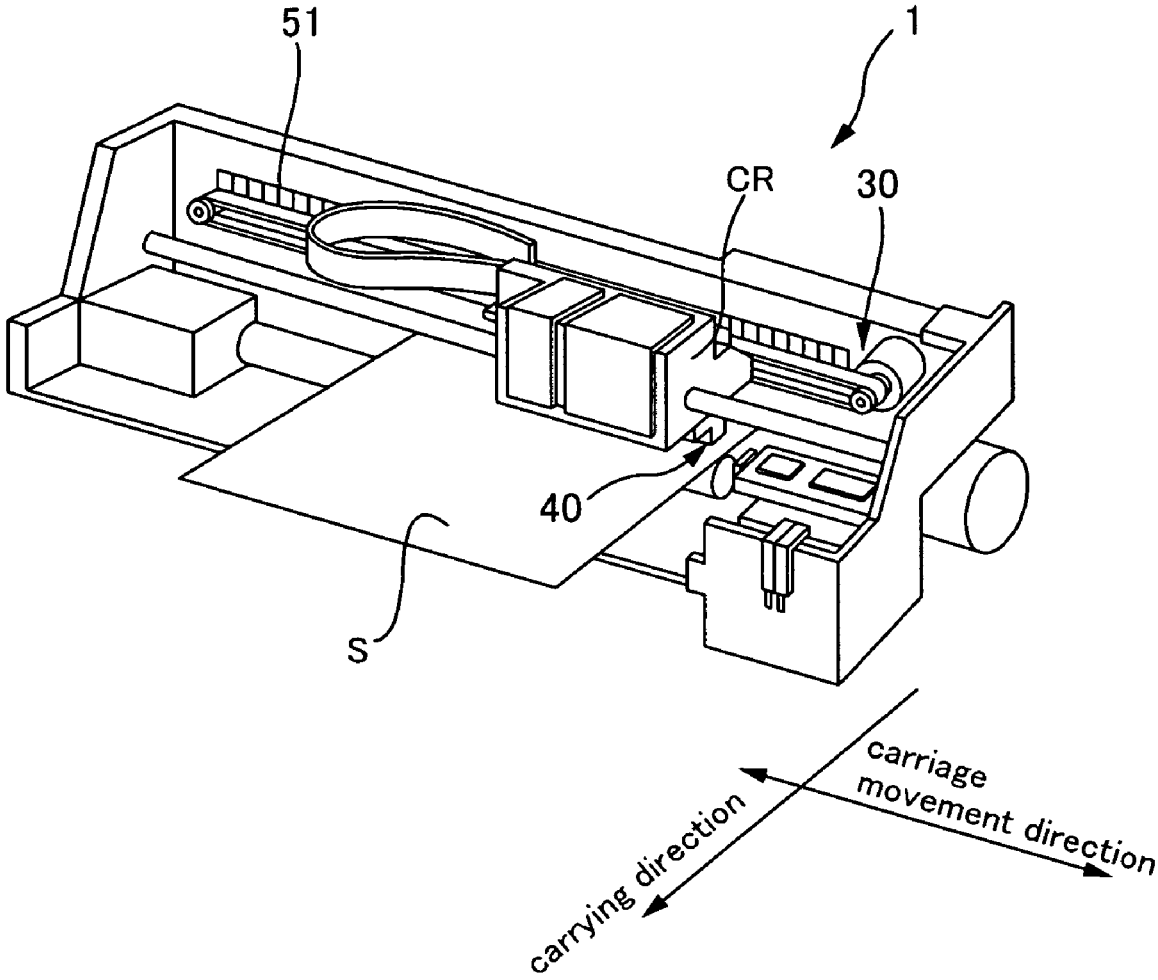
FIG. 3 is a diagram showing the configuration of the printer 1 of the embodiments.

FIG. 3 is a diagram showing the configuration of the printer 1 of the present embodiment. It should be noted that in the following description, reference is also made to FIG. 2.

The printer 1 has a paper carry mechanism 20, a carriage movement mechanism 30, a head unit 40, a detector group 50, a printer-side controller 60, and a drive signal generation circuit 70. In the present embodiment, the printer-side controller 60 and the drive signal generation circuit 70 are provided on a common controller board CTR. Moreover, the head unit 40 has a head controller HC and a head 41.

In the printer 1, the printer-side controller 60 controls the sections to be controlled, i.e., the paper carry mechanism 20, the carriage movement mechanism 30, the head unit 40 (head controller HC, head 41), and the drive signal generation circuit 70. Thus, based on the print data received from the computer 110, the printer-side controller 60 causes the image to be printed on the paper S. Moreover, the detectors in the detector group 50 monitor the conditions in the printer 1. The detectors output the detection results to the printer-side controller 60. The printer-side controller 60 receives the detection results from the detectors, and controls the sections to be controlled based on the detection results.

The paper carry mechanism 20 is for carrying media in the carrying direction. The paper carry mechanism 20 feeds the paper S up to a printable position, and also carries the paper S in a carrying direction by a predetermined carry amount. The carrying direction is a direction that intersects the carriage movement direction.

The carriage movement mechanism 30 is for moving a carriage CR to which the head unit 40 is attached in the carriage movement direction. The carriage movement direction includes a movement direction from one side to the other side and a movement direction from the other side to the one side. It should be noted that since the head unit 40 has the head 41, the carriage movement direction corresponds to the movement direction of the head 41, and the carriage movement mechanism 30 moves the head 41 in the movement direction.

The head unit 40 is for ejecting ink toward the paper S. The head unit 40 is attached to the carriage CR. The head 41 of the head unit 40 is provided on the lower surface of a head case. Moreover, the head controller HC of the head unit 40 is provided inside the head case. The head controller HC is described in greater detail later.

The detector group 50 is for monitoring the conditions in the printer 1. The detector group 50 includes, among others, a linear encoder 51 for detecting the position of the carriage CR in the movement direction. Additionally, the detector group 50 also includes a sensor for detecting the carry amount of the paper (such as an encoder that detects the amount of rotation of the carry roller for carrying the paper).

The printer-side controller 60 performs control of the printer 1. The printer-side controller 60 has an interface section 61, a CPU 62, a memory 63, and a control unit 64. The interface section 61 exchanges data with the computer 110, which is an external apparatus. The CPU 62 is a computer processing unit for performing overall control of the printer 1. The memory 63 is for reserving an area for storing programs for the CPU 62 and a working area, for example, and is constituted by a storage element such as a RAM, an EEPROM, or a ROM. The CPU 62 controls the sections to be controlled according to the computer programs stored on the memory 63. For example, the CPU 62 controls the paper carry mechanism 20 and the carriage movement mechanism 30 via the control unit 64. Moreover, the CPU 62 outputs head control signals for controlling the operation of the head 41 to the head controller HC and outputs a generation signal for generating a drive signal COM to the drive signal generation circuit 70. When printing, the printer-side controller 60 alternately repeats a dot formation operation of ejecting ink from the head 41 while moving the carriage CR so as to form dots on a paper, and a carrying operation of causing the paper carry mechanism 20 to carry the paper, thereby printing an image on the paper.

The drive signal generation circuit 70 generates drive signals COM. The drive signal generation circuit 70, depending on the embodiments described later, generates one type of drive signal COM or generates two types of drive signals COM (first drive signal COM_A, second drive signal COM_B).

Configuration of the Head 41

Figure 4:
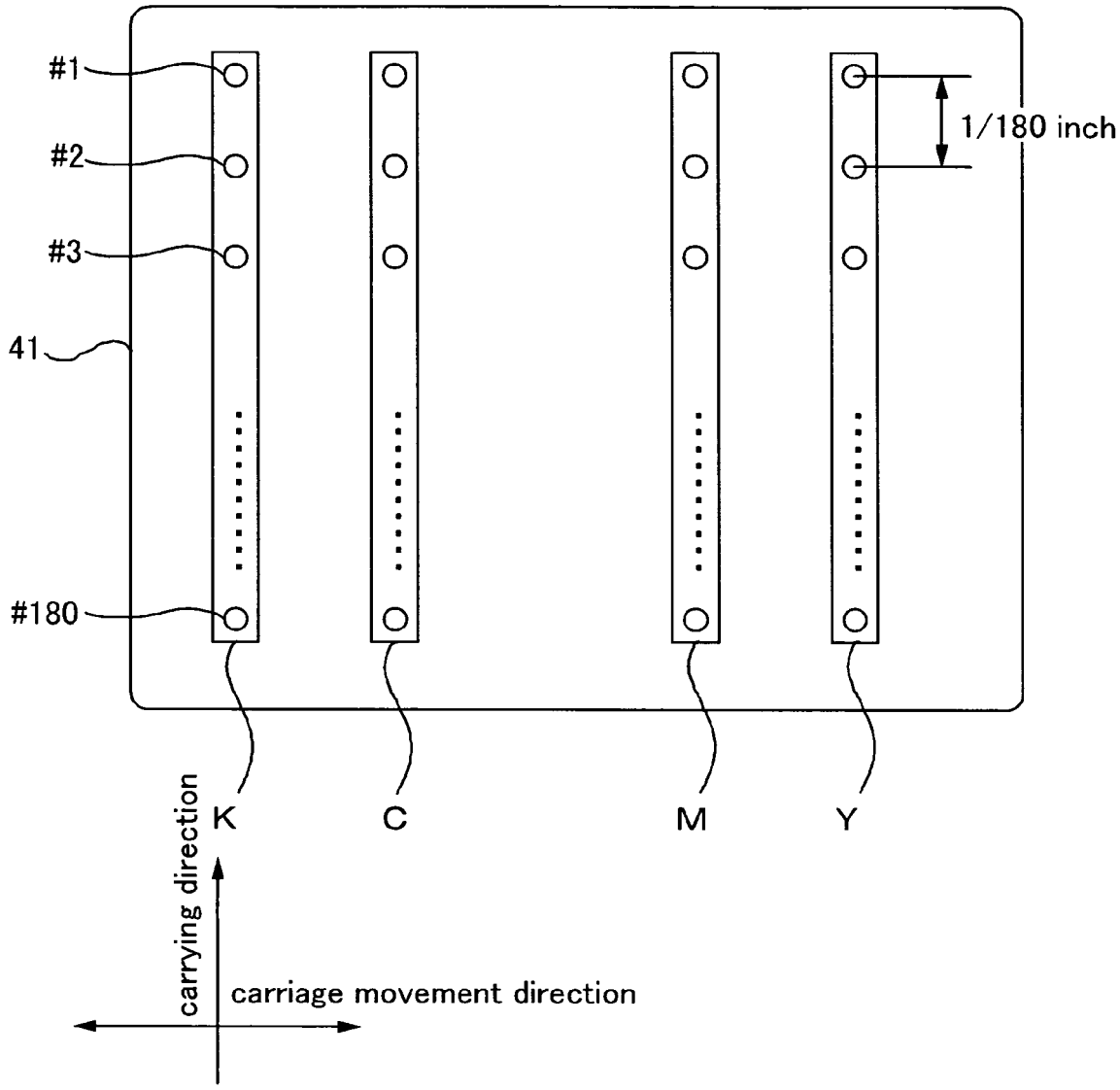
FIG. 4 is an explanatory diagram of the nozzles provided in the head 41.

FIG. 4 is an explanatory diagram of the nozzles provided in the head 41. A black ink nozzle group K, a cyan ink nozzle group C, a magenta ink nozzle group M, and a yellow ink nozzle group Y are formed in the lower surface of the head 41. Each nozzle group is provided with 180 nozzles that are ejection openings for ejecting ink of that color. Each nozzle is provided with an ink chamber (not shown) and a piezo element. Driving the piezo element causes the ink chamber to expand and contract, thereby ejecting an ink droplet from the nozzle. From the various nozzles it is possible to eject a plurality of types of ink in differing amounts. Thus, dots of different sizes can be formed on the paper.

Figure 5:
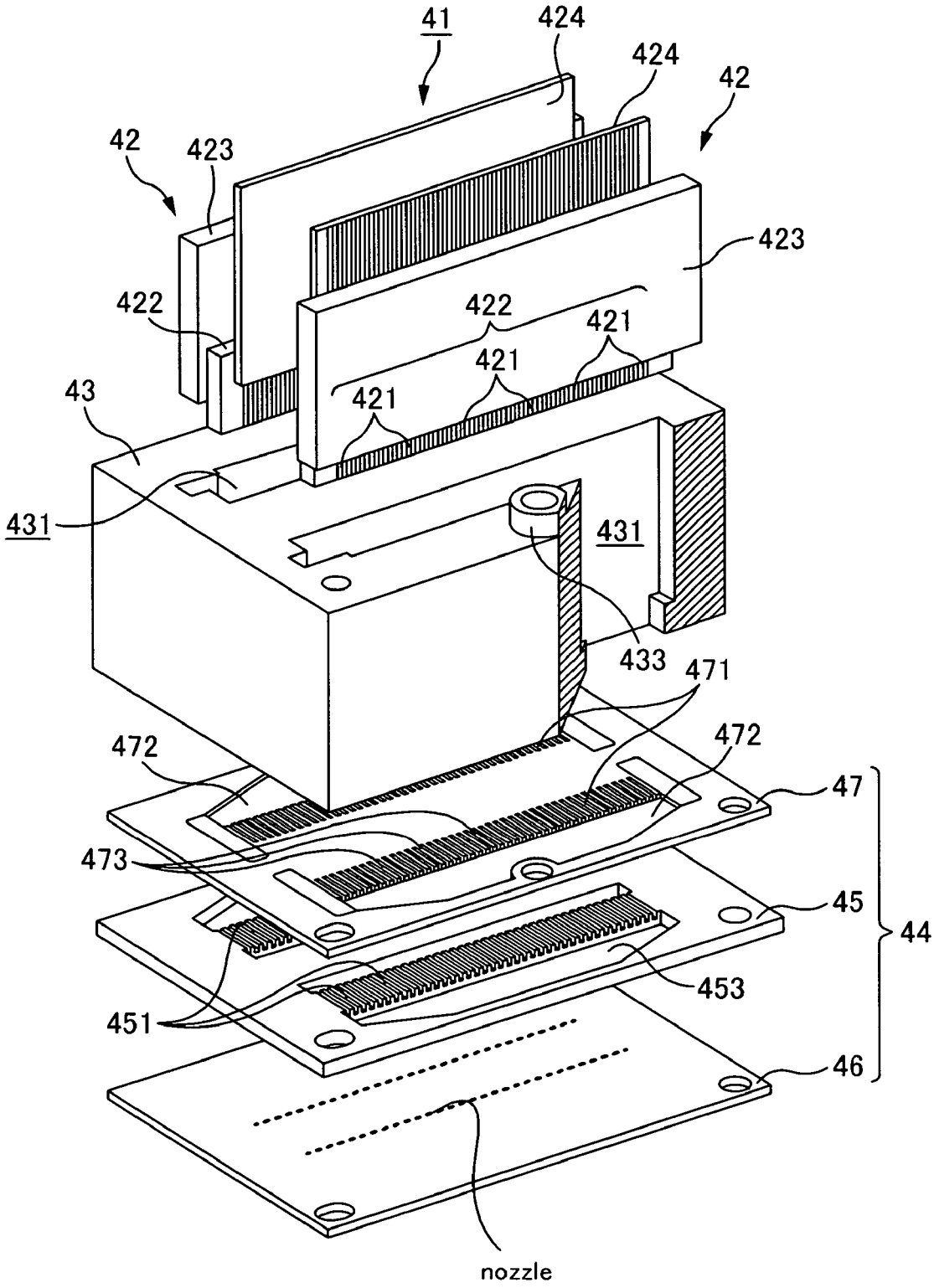
FIG. 5 is an explanatory diagram of the configuration surrounding the black ink nozzle group K and the cyan ink nozzle group C.
Figure 6:
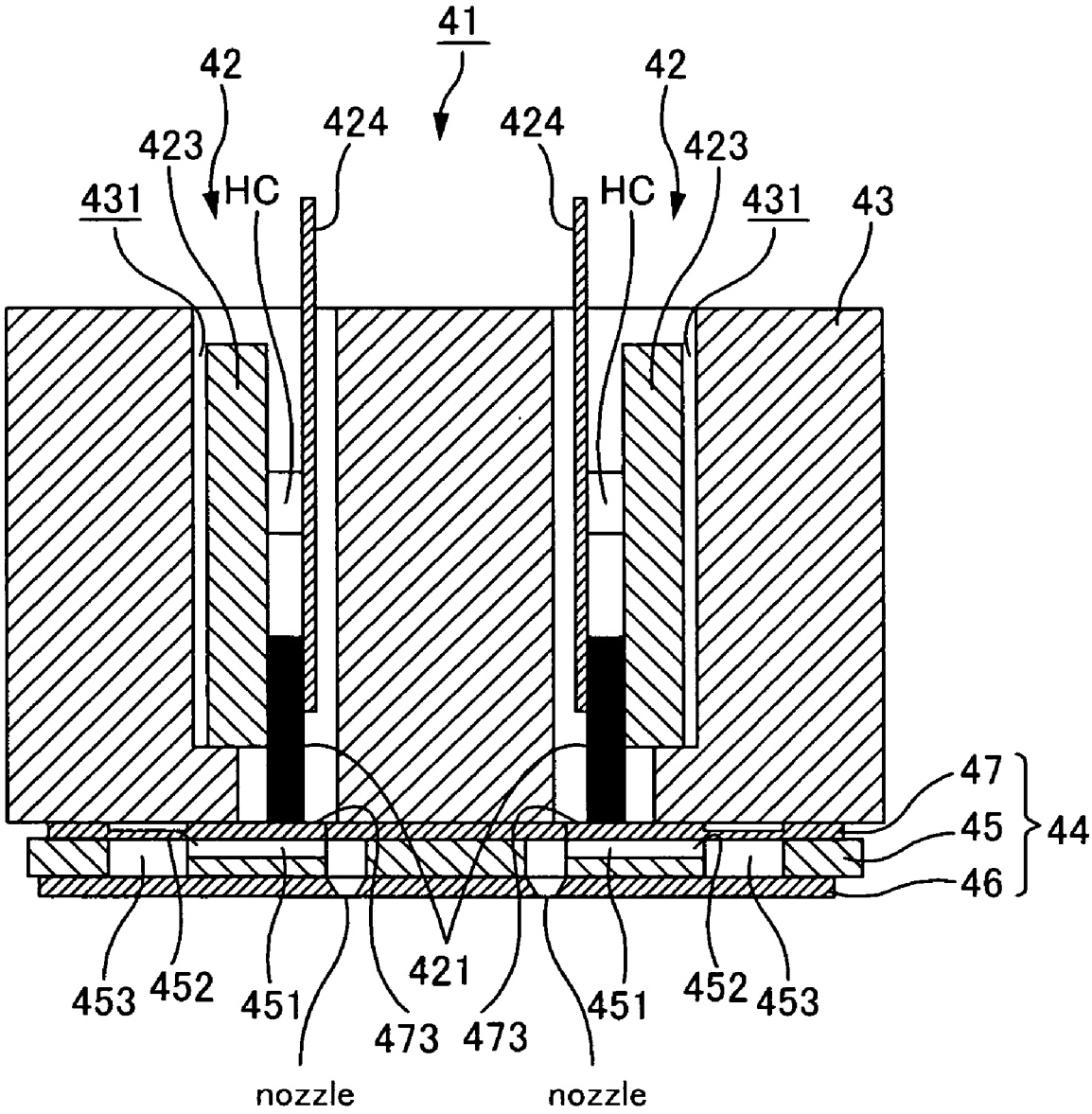
FIG. 6 is a cross-sectional diagram of the surroundings of the two nozzle groups.

FIG. 5 is an explanatory diagram of the configuration of the area around the black ink nozzle group K and the cyan ink nozzle group C. FIG. 6 is a cross-sectional diagram of the area around the two nozzle groups.

In the vicinity of the nozzle groups, there are provided drive units 42, a case 43 for storing the drive units 42, and a channel unit 44 in which the case is mounted.

Each drive unit 42 is constituted by a piezo element group 422 made of a plurality of piezo elements 421, a fixing plate 423 onto which the piezo element group 422 is fixed, and a flexible cable 424 for supplying power to each piezo element 421. Each piezo element 421 is attached to the fixing plate 423 in a so-called cantilever fashion. The fixing plate 423 is a plate-shaped member that possesses sufficient rigidity to stop the reaction force from the piezo elements 421. The flexible cable 424 is a sheet-shaped circuit board that is flexible and that is electrically connected to the piezo elements 421 on a lateral face of the fixing end portion that is on the side opposite the fixing plate 423. Ahead controller HC, which is a control IC for controlling the driving of the piezo elements 421, for example, is mounted on the surface of the flexible cable 424. As shown in the drawings, a head controller HC is provided for each nozzle group, that is, for each color. The head controller HC will be described in greater detail later.

The case 43 has a rectangular block-shaped exterior shape that has storage spaces 431 each of which can store a drive unit 42. The channel unit 44 is joined to the forward end of the case 43. Each storage space 431 is large enough that the drive unit 42 just fits therein. An ink supply tube 433 for introducing ink from an ink cartridge to the channel unit 44 is also formed in the case 43.

The channel unit 44 has a channel forming substrate 45, a nozzle plate 46, and an elastic plate 47, which are stacked on one another and form a single unit in such a manner that the channel forming substrate 45 is sandwiched by the nozzle plate 46 and the elastic plate 47. The nozzle plate 46 is a thin stainless steel plate on which nozzle rows such as those shown in FIG. 4 are formed.

A plurality of pressure chambers 451 and spaces that become ink supply openings 452 are formed, each corresponding to a nozzle, in the channel forming substrate 45. A reservoir 453 is a liquid storage compartment for supplying the ink stored in the ink cartridge to each pressure chamber 451, and it is in communication with the other end of the corresponding pressure chamber 451 via the ink supply port 452. The ink from the ink cartridge is introduced to the reservoir 453 through an ink supply tube 433. The elastic plate 47 is provided with a diaphragm section 471. The elastic plate 47 is also provided with a compliance section 472 that seals one of the open surfaces of the empty space that becomes the reservoir 453. With the elastic plate 47, a support plate is etched away to leave island portions 473. The forward end of the free end portion of the piezo elements 421 is adhered to these island portions 473.

The drive unit 42 is inserted to the storage space 431 with the free end portion of the piezo elements 421 facing the channel unit 44, and the front end surface of the free end portions are adhered to the corresponding island section 473. The rear surface of the fixing plate, which is on the side opposite the piezo element group binding surface, is adhered to the interior wall surface of the case 43, which defines the storage spaces 431. When, in this accommodated state, a drive signal is supplied to a piezo element 421 via the flexible cable 424, the piezo element 421 expands and contracts, increasing and decreasing the volume of its pressure chamber 451. This change in the volume of the pressure chamber 451 alters the pressure of the ink in the pressure chamber 451. In this way, the change in ink pressure can be utilized to cause an ink droplet to be ejected from the nozzle.

To facilitate understanding of the embodiments, first the embodiments are explained with the help of reference examples, and then the embodiments will be described.

FIRST REFERENCE EXAMPLE (4 GRADATION PRINTING)

Regarding the Drive Signal COM

Figure 7:
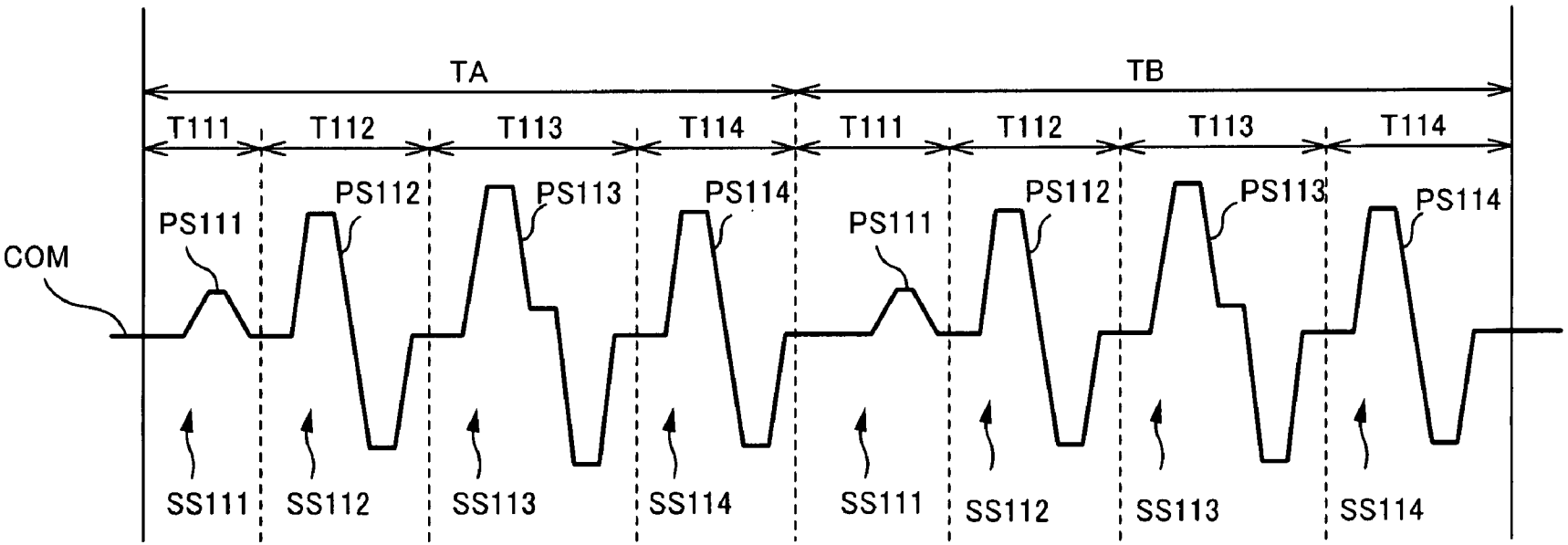
FIG. 7 is an explanatory diagram of the drive signal COM in the first reference example.

FIG. 7 is an explanatory diagram of the drive signal COM in the first reference example.

The drive signal COM is repeatedly generated each repeating period T. The repeating period T is time required for the carriage CR to move a predetermined distance. The drawing shows two consecutive repeating periods T (TA and TB). The drive signal has the same waveform in the early repeating period TA and in the latter repeating period TB. Thus, each time that the carriage CR moves a predetermined distance, a drive signal with a fixed waveform is repeatedly generated by the drive signal generation circuit 70.

Each repeating period T can be divided into four intervals T111 to T114. A first interval signal SS111 that includes a drive pulse PS111 is generated in the first interval T111, a second interval signal SS112 that includes a drive pulse PS112 is generated in the second interval T112, a third interval signal SS113 that includes a drive pulse PS113 is generated in the third interval T113, and a fourth interval signal SS114 that includes a drive pulse PS114 is generated in the fourth interval T114. It should be noted that the waveforms of the drive pulses PS111 to PS114 are determined based on the operation that the piezo element 421 is to perform.

The drive signal COM that is generated in the drive signal generation circuit 70 is input to the head controller HC along with other signals via the cable.

Head Controller HC

Figure 8:
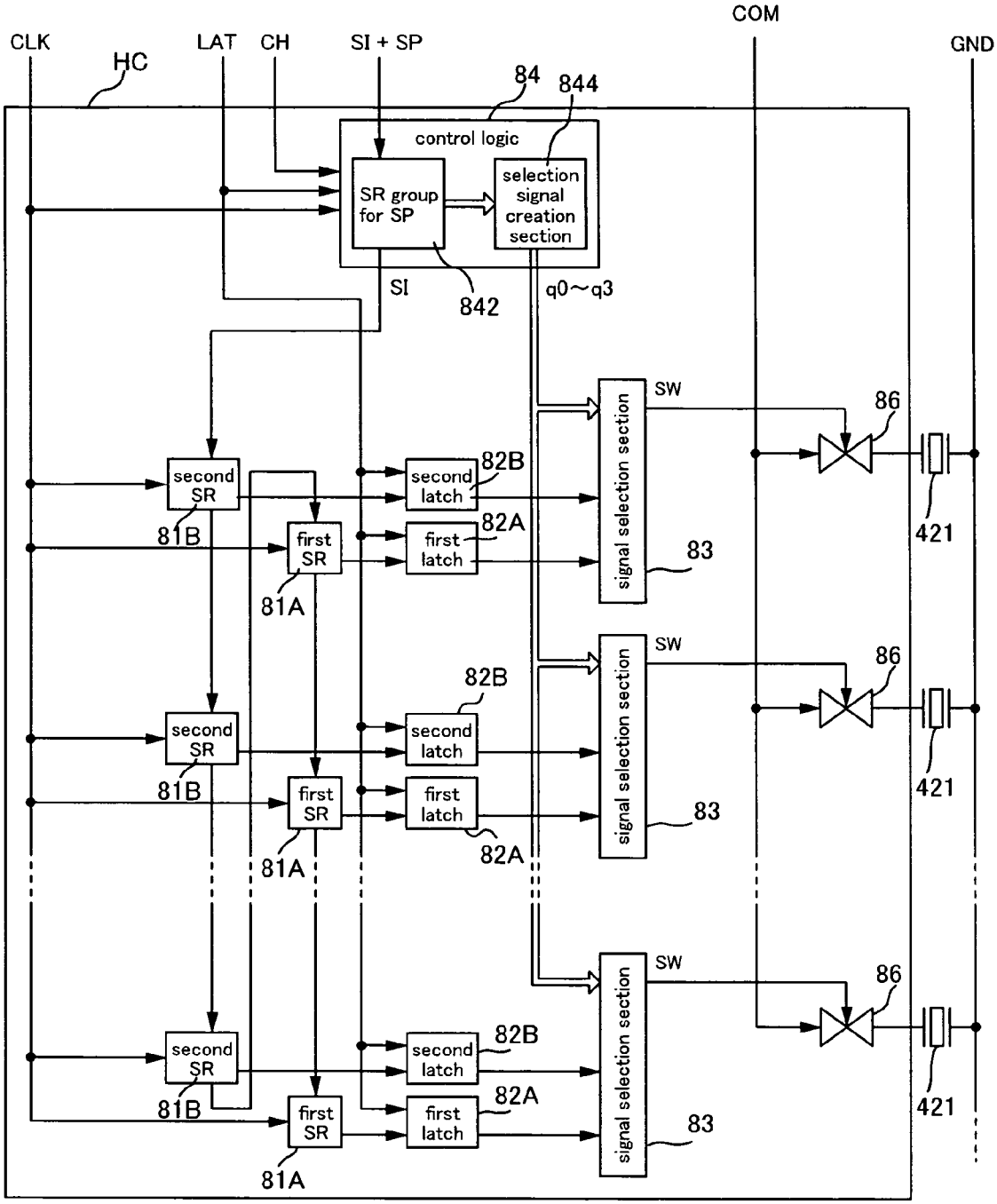
FIG. 8 is a block diagram of the head controller HC of the first reference example.

FIG. 8 is a block diagram of the head controller HC of the first reference example.

The head controller HC is provided with a first shift register 81A, a second shift register 81B, a first latch circuit 82A, a second latch circuit 82B, a signal selection section 83, a control logic 84, and a switch 86. Each one of the sections aside from the control logic 84 (that is, the first shift register 81A, the second shift register 81B, the first latch circuit 82A, the second latch circuit 82B, the signal selection section 83, and the switch 86) is provided for each piezo element 421. The control logic 84 has a shift register group 842 for storing setting data SP, end a selection signal creation section 844 that creates selection signals q0 to q3 based on the selection data SP.

A clock CLK, a latch signal LAT, a change signal CH, and a drive signal COM are input from the printer-side controller 60 to the head controller HC via the cable. A setting signal that includes pixel data SI and setting data SP also is input to the head controller HC from the printer-side controller 60 via the cable.

Figure 9:
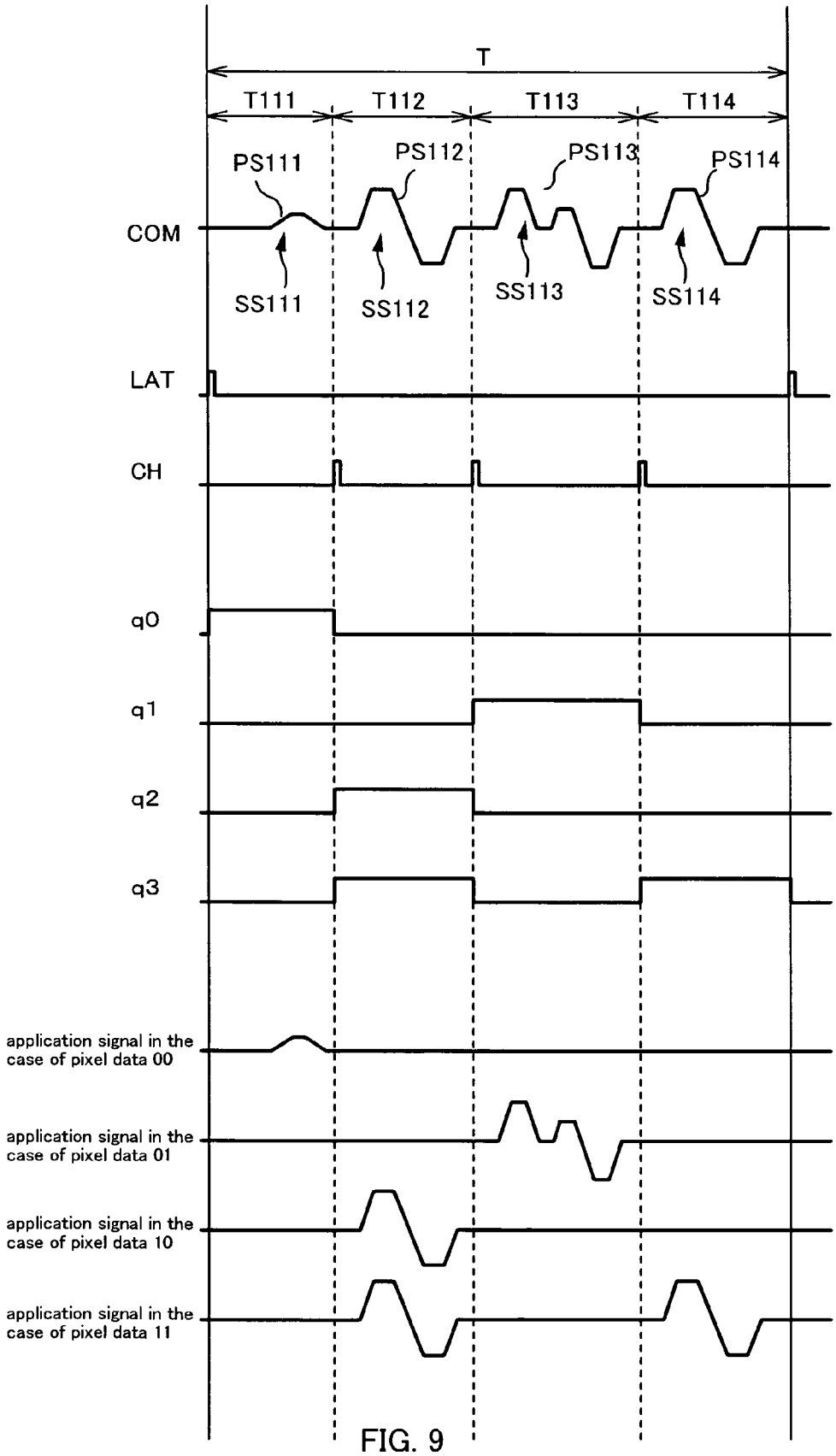
FIG. 9 is an explanatory diagram of the various signals of the first reference example.
Figure 10A:
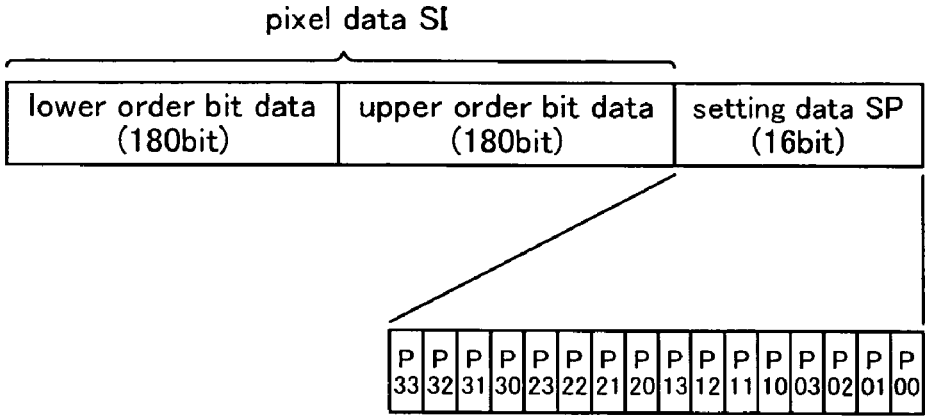
FIG. 10A is an explanatory diagram of the setting signal, which includes pixel data SI and setting data SP.
Figure 10B:
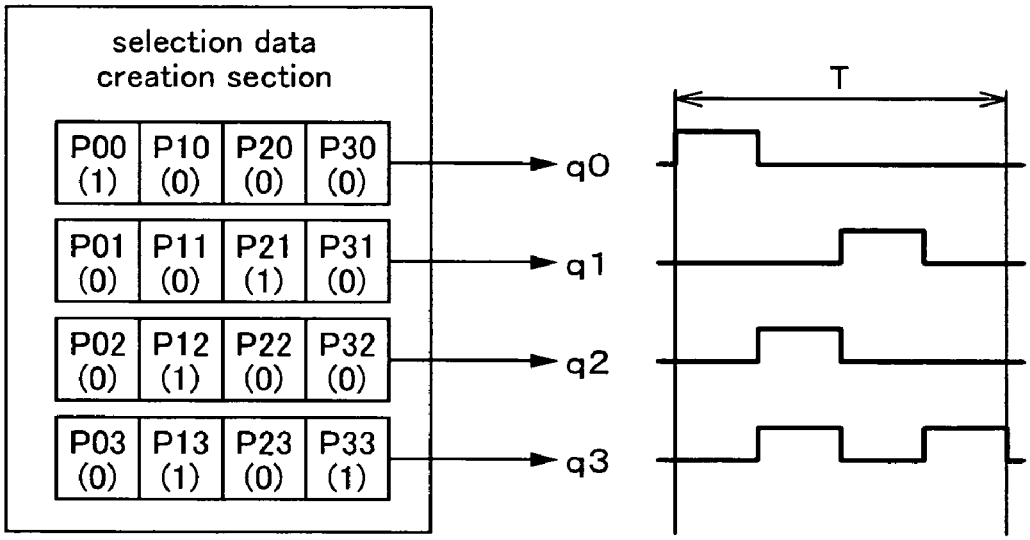
FIG. 10B is an explanatory diagram of the function of the selection signal creation section 844.

FIG. 9 is an explanatory diagram of the various signals of the first reference example. FIG. 10A is an explanatory diagram of the setting signal, which includes pixel data SI and setting data SP. FIG. 10B is an explanatory diagram of the function of the selection signal creation section 844.

When the setting signal is input to the head controller HC in synchronization with the clock CLK, the lower order bit data in the setting signal are set to the first shift registers 81A, the upper order bit data are set to the second shift registers 81B, and the setting data SP are set to the shift register group 842 of the control logic 84. It should be noted that the lower order bit of the two bits of pixel data corresponding to the nozzle is set to the first shift registers 81A, and the upper order bit of the two bits of pixel data is set to the second shift registers 81B.

In correspondence with the pulse of the latch signal LAT, the lower order bit data are latched in the first latch circuits 82A, the upper order bit data are latched in the second latch circuits 82B, and the setting data SP are latched in the selection signal creation section 844. It should be noted that the lower order bit of the two bits of pixel data that correspond to the nozzle is latched by the first latch circuit 82A, and the upper order bit of the two bits of pixel data is latched by the second latch circuit 82B.

The setting data SP of the first reference example is made of 16 bits of data (see FIG. 10A). The selection signal creation section 844 creates the selection signal q0 based on predetermined four bits of data (data P00, data P10, data P20, data P30) of the 16-bit setting data SP and the change signal CH. Likewise, the selection signal creation section 844 creates the selection signals q1 to q3 based on predetermined four bits of data in the 16-bit setting data SP and the change signal CH.

In the first example, of the 16-bit setting data SP, the data P00, the data P12, the data P13, the data P21, and the data P33 are 1, and the other data are 0. Thus, the four bits of data (data P00, data P10, data P20, and data P30) for the selection signal q0 are 1000. As a result, the selection signal q0 is H level in the first interval T111, and is L level in the second interval T112 through the fourth interval T114. The selection signals q1 to q3 become the signals that are shown in the drawing.

The signal selection section 83 selects one selection signal q0 to q3 according to the 2-bit pixel data that has been latched by the first latch circuit 82A and the second latch circuit 82B. The selection signal q0 is selected if the pixel data are 00 (the lower order bit is 0 and the upper order bit is 0), the selection signal q1 is selected if the pixel data are 01, the selection signal q2 is selected if the pixel data are 10, and the selection signal q3 is selected if the pixel data are 11. The selection signal that is selected is output from the signal selection section 83 as the switch signal SW.

The drive signal COM and the switch signal SW are input to the switch 86. When the switch signal is H level, the switch 86 becomes on and the drive signal COM is input to the piezo element 421. When the switch signal is L level, the switch 86 becomes off and the drive signal COM is not input to the piezo element 421.

When the pixel data are 00, the switch 86 is switched on or off by the selection signal q0, and the first interval signal SS111 of the drive signal COM is input to the piezo element 421 and the piezo element 421 is driven by the drive pulse PS111. When the piezo element 421 is driven according to the drive pulse PS111, the ink is subjected to a change in pressure to a degree that does not result in the ejection of ink, and the ink meniscus (the free surface of the ink that is exposed at the nozzle portion) is finely vibrated.

When the pixel data are 01, the switch 86 is switched on or off by the selection signal q1, and the third interval signal SS113 of the drive signal COM is input to the piezo element 421 and the piezo element 421 is driven by the drive pulse PS113. When the piezo element 421 is driven according to the drive pulse PS113, a small quantity of ink is ejected and forms a small dot on the paper.

When the pixel data are 10, the switch 86 is switched on or off by the selection signal q2, and the second interval signal SS112 of the drive signal COM is input to the piezo element 421 and the piezo element 421 is driven by the drive pulse PS112. When the piezo element 421 is driven according to the drive pulse PS112, a medium quantity of ink is ejected and forms a medium dot on the paper.

When the pixel data are 11, the switch 86 is switched on or off by the selection signal q3, and the second interval signal SS112 and the fourth interval signal SS114 of the drive signal COM are input to the piezo element 421 and the piezo element 421 is driven by the drive pulse PS112 and the drive pulse PS114. When the piezo element 421 is driven according to the drive pulse PS112 and the drive pulse PS114, a large dot is formed on the paper.

It should be noted that during the time that the piezo element 421 is being driven in the repeating period TA of FIG. 7, a setting signal (pixel data SI and setting data SP) for driving the piezo element 421 in the next repeating period TB is input to the head controller HC. That is to say, during the repeating period TA, it is necessary to set the lower order bit data, the upper order bit data, and the setting data for the next repeating period TB in the various shift registers.

SECOND REFERENCE EXAMPLE (EIGHT GRADATION PRINTING)

In the first reference example above, four shades (no dot, small dot, medium dot, large dot) can be formed for each pixel on the paper. In contrast, in the second reference example described below, it is possible to eject ink droplets in amounts of 0 pl (minute vibration with no ejection of ink), 1.5 pl (picoliter), 3 pl, 4.5 pl, 7 pl, 8.5 pl, 10 pl, and 14 pl, to form eight shades for each pixel on the paper.

Regarding the Head Controller HC

Figure 11:
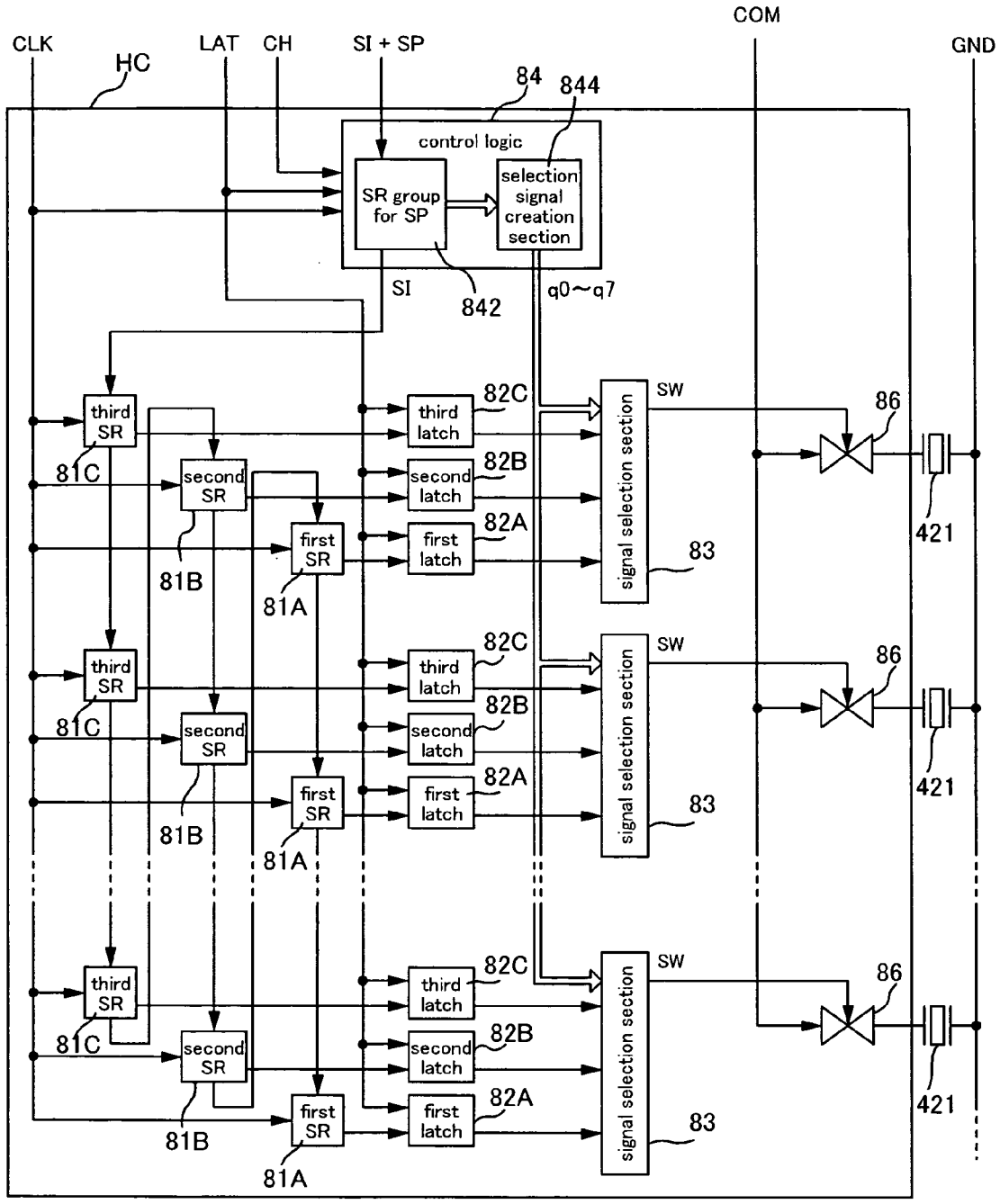
FIG. 11 is a block diagram of the head controller HC of the second reference example.

FIG. 11 is a block diagram of the head controller HC of the second reference example. Compared to that of the first reference example, the head controller HC of the second reference example is further provided with a third shift register 81C and a third latch circuit 82C. Also, the selection signal creation section 844 creates eight types of selection signals q0 to q7.

Figure 12:
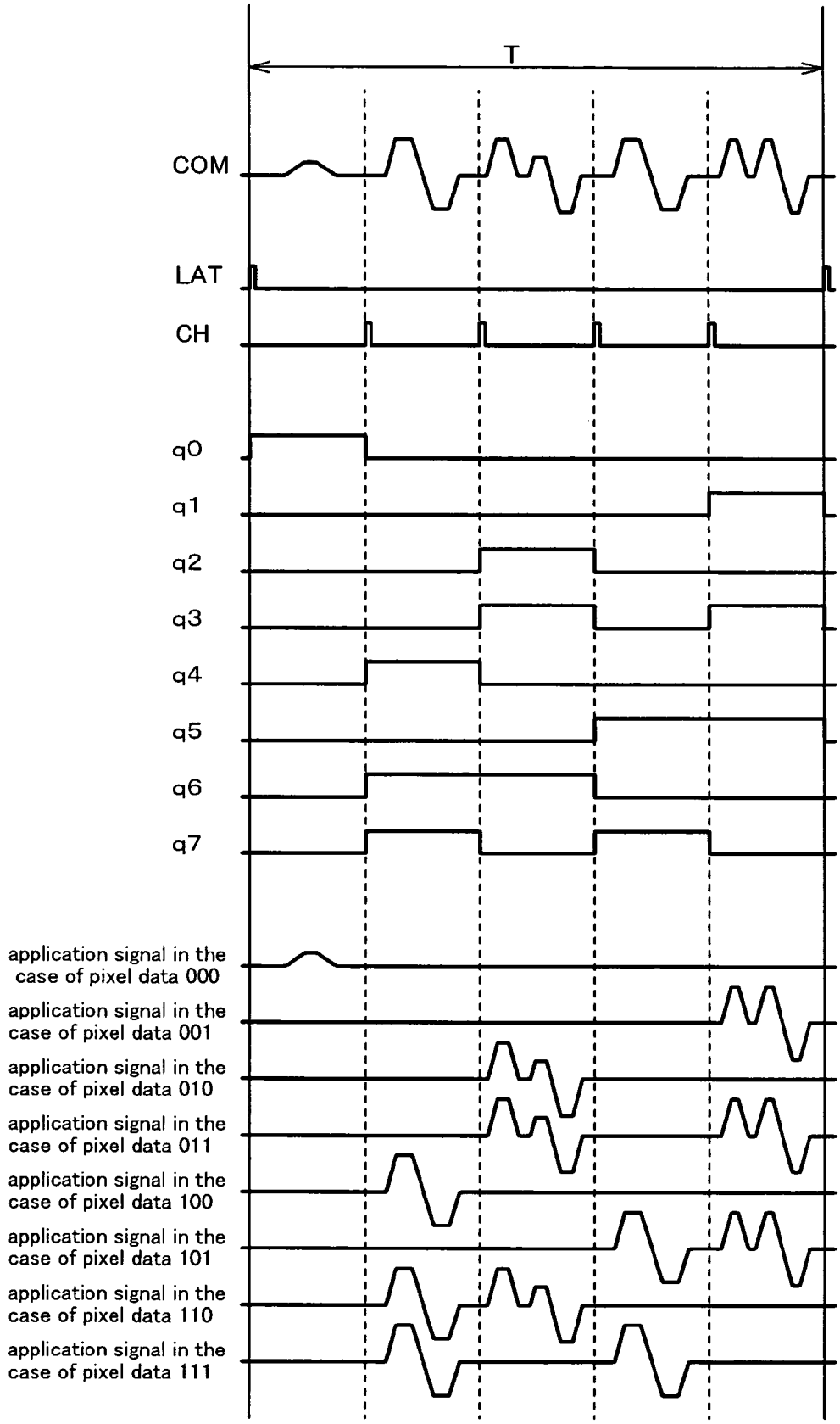
FIG. 12 is an explanatory diagram of the various signals of the second reference example.
Figure 13A:
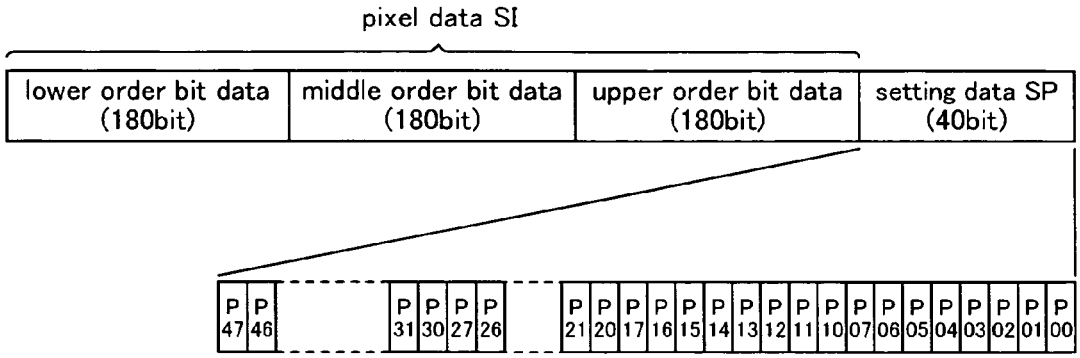
FIG. 13A is an explanatory diagram of the setting signal, which includes pixel data SI and setting data SP.
Figure 13B:
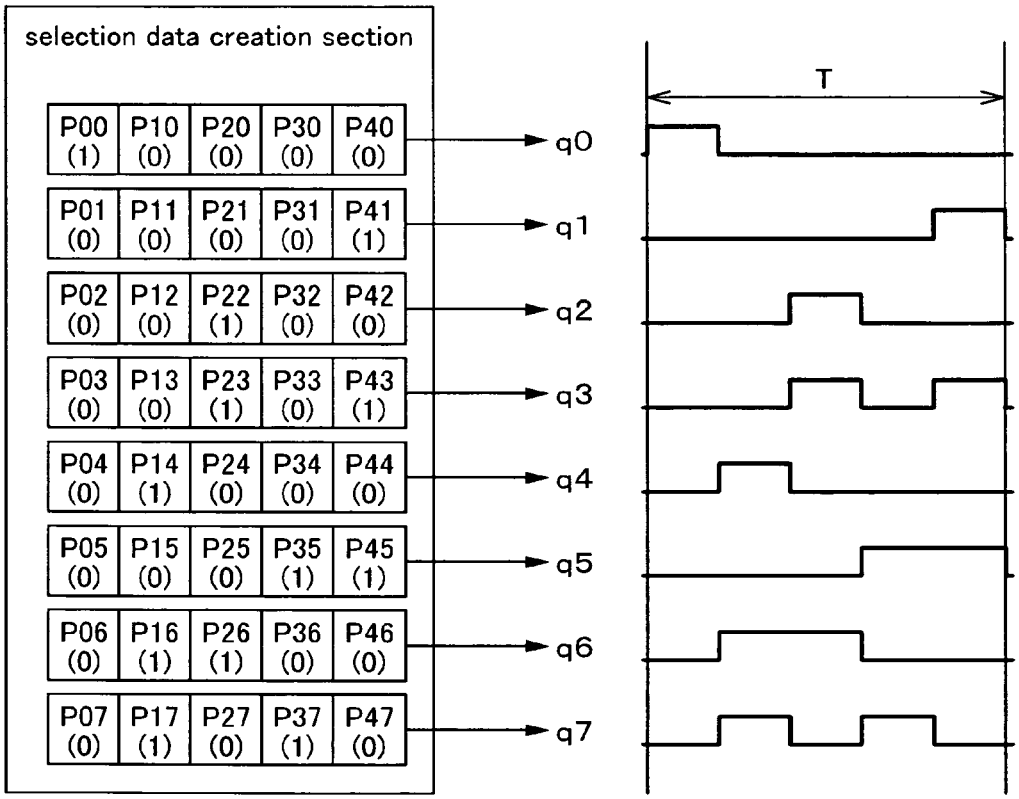
FIG. 13B is an explanatory diagram of the function of the selection signal creation section 844.

FIG. 12 is an explanatory diagram of the various signals of the second reference example. FIG. 13A is an explanatory diagram of the setting signal, which include the pixel data SI and the setting data SP. FIG. 13B is an explanatory diagram of the function of the selection signal creation section 844.

To express eight gradations in the second reference example, it is necessary to correspond three bits of pixel data with a single pixel (in the first example, two bits of pixel data are corresponded with a single pixel). For this reason, the pixel data SI of the setting signal are made of an upper order bit data, middle order bit data, and lower order bit data (see FIG. 13A).

Further, in the second reference example, the repeating period T is divided into five intervals (in the first reference example, the repeating period T is divided into four intervals). This is because to express eight gradations it is necessary to apply eight types of application signals to the piezo elements 421 (see FIG. 12), and thus it is necessary to increase the number of waveforms to be prepared for a repeating period T.

In the second reference example, the setting data of the setting signal are 40 bits of data (in the first reference example, the setting data was 16 bits). More specifically, in the second reference example, it is necessary for the selection signal creation section 844 to create eight types of selection signals q0 to q7 in order to create eight types of application signals from the drive signal COM, and it is necessary to determine whether each selection signal is L level or H level in the five intervals, and thus the setting data become a data amount of 8 (types)×5 (intervals)=40 (bits).

Then, when the setting signal is input to the head controller HC of the second reference example, the lower order bit data are set to the first shift registers 81A, the middle order bit data are set to the second shift registers 81B, and the upper order bit data are set to the third shift registers 81C, and the setting data SP are set to the shift register group 842 of the control logic 84. Then, in accordance with the pulse of the latch signal LAT, the lower order bit data are latched by the first latch circuits 82A, the middle order bit data are latched by the second latch circuits 82B, and the upper order bit data are latched by the third latch circuits 82C, and the setting data SP are latched by the selection signal creation section 844.

The selection signal creation section 844 creates the selection signals q0 to q7 based on predetermined four bits data of the 40 bits of setting data and the change signal CH. The signal selection section 83 selects one of the selection signals q0 to q7 according to the three bits of pixel data latched by the first latch circuit 82A through the third latch circuit 82C. The selection signal that has been selected is output from the signal selection section 83 as the switch signal SW.

Thus, the piezo elements 421 are driven according to 3-bit pixel data, and an ink droplet that corresponds to the 3-bit pixel data is ejected (or not ejected), forming a dot that corresponds to the 3-bit pixel data on the paper.

In the second example, there is an increase in the amount of data to be set in the shift registers for the next repeating period during a given repeating period T. Since the data are serially transferred, it takes time to set a larger amount of data. As a result, it is not possible to set a shorter repeating period T in the second reference example.

Mixed Printing of Two Gradation Types

Incidentally, there is a demand for the ability to change the number of expressible gradations depending on the ink color. For example, photograph printing requires high picture quality and thus it is necessary to raise the number of expressible gradations, but since black ink is used mostly in test printing and is not frequently used in photograph printing, the number of gradations of black ink does not have to be raised as much as the color ink. Even among color inks, yellow ink is a relatively light colored ink and thus it is not necessary to raise the number of gradations of yellow ink as much as cyan ink or magenta ink, which are relatively dark in color.

In this way, for example there is a demand for black and yellow to be printed in four gradations and for cyan and magenta to be printed in eight gradations. However, simply combining four gradation printing and eight gradation printing results in the problem discussed below.

Figure 14A:
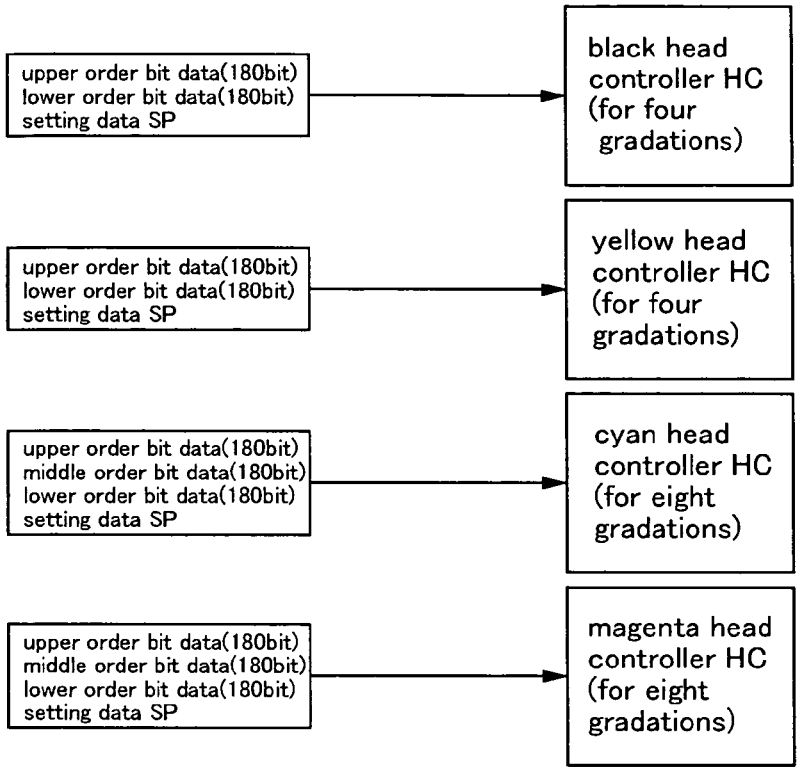
FIG. 14A is an explanatory diagram of a first comparative example.

FIG. 14A is an explanatory diagram of a first comparative example. In the first comparative example, the head controllers for black and yellow have the same configuration as the head controller HC of the first reference example (see FIG. 8), and the head controllers for cyan and magenta have the same configuration as the head controller HC of the second reference example (see FIG. 11).

To manufacture the head unit 40 of the first reference example, it is necessary to produce two types of control ICs for the head controller for four gradation printing and the head controller for eight gradation printing, and thus there is the problem of increased production costs for the head unit 40.

Figure 14B:
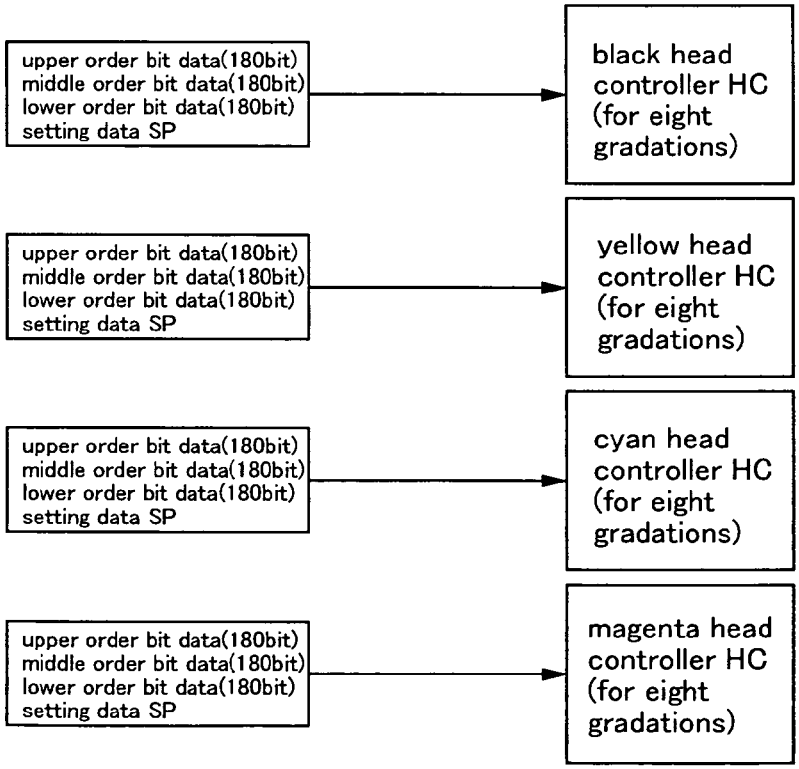
FIG. 14B is an explanatory diagram of a second comparative example.

FIG. 14B is an explanatory diagram of a second comparative example. In the second comparative example, the head controller for eight gradation printing of the second reference example (see FIG. 11) is used in common, and thus the problem of production costs seen in the first comparative example is eliminated.

However, since the head controller of the second reference example is simply used in common for each of the colors, it is necessary to send data for eight gradation printing also to head controllers that perform only four gradation printing, and thus there is the problem of an increased amount of data to be set and the fact that it takes time to set the data.

Figure 15:
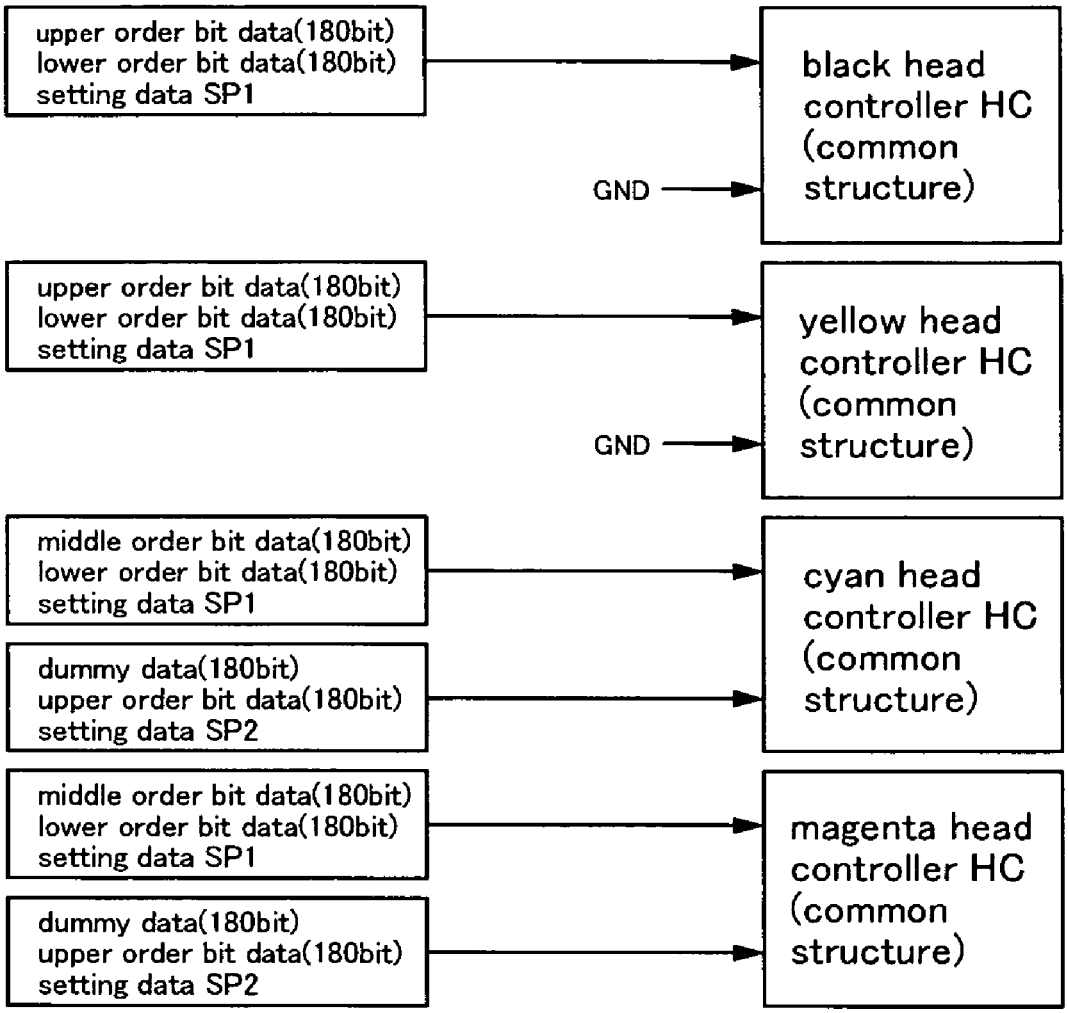
FIG. 15 is an explanatory diagram of an overview of the embodiment.

FIG. 15 is an explanatory diagram outlining the embodiments described below. The head controllers of the embodiments are used in common for each of the colors. Further, the head controllers of the embodiments differ from that of the second reference example, and has two input sections for receiving the setting signals for setting the pixel data SI and the setting data SP. One of these input sections is common for each color and receives a first setting signal for setting two bits of pixel data and the first setting data SP1.

Then, in the case of the head controller for cyan and magenta, for which eight gradation printing is performed, to the other input section is input a second setting signal for setting the remaining pixel data (the upper order bit data) and the second setting data SP2. The head controller then drives the piezo elements 421 based on the three bits of pixel data, the first setting data SP1, and the second setting data SP2, forming eight shades per pixel on the paper.

On the other hand, in the case of the head controller for black and yellow, for which four gradation printing is performed, the other input section is connected to the GND. This head controller drives the piezo elements 421 based on the two bits of pixel data and the first setting data SP1, forming four shades per pixel on the paper.

With the head controllers of the embodiments, a common head controller can be used for each color, and thus the problem of production costs can be resolved. Further, with the head controllers of the embodiments, the amount of data serially transferred to each input section is smaller than in the case of the second reference example, and thus it is not time consuming to set the data.

First Embodiment (Mixed Printing of Four Gradations and Eight Gradations)

Regarding the Relationship Between the Pixel Data and the Ink Droplet Size

Figure 16:
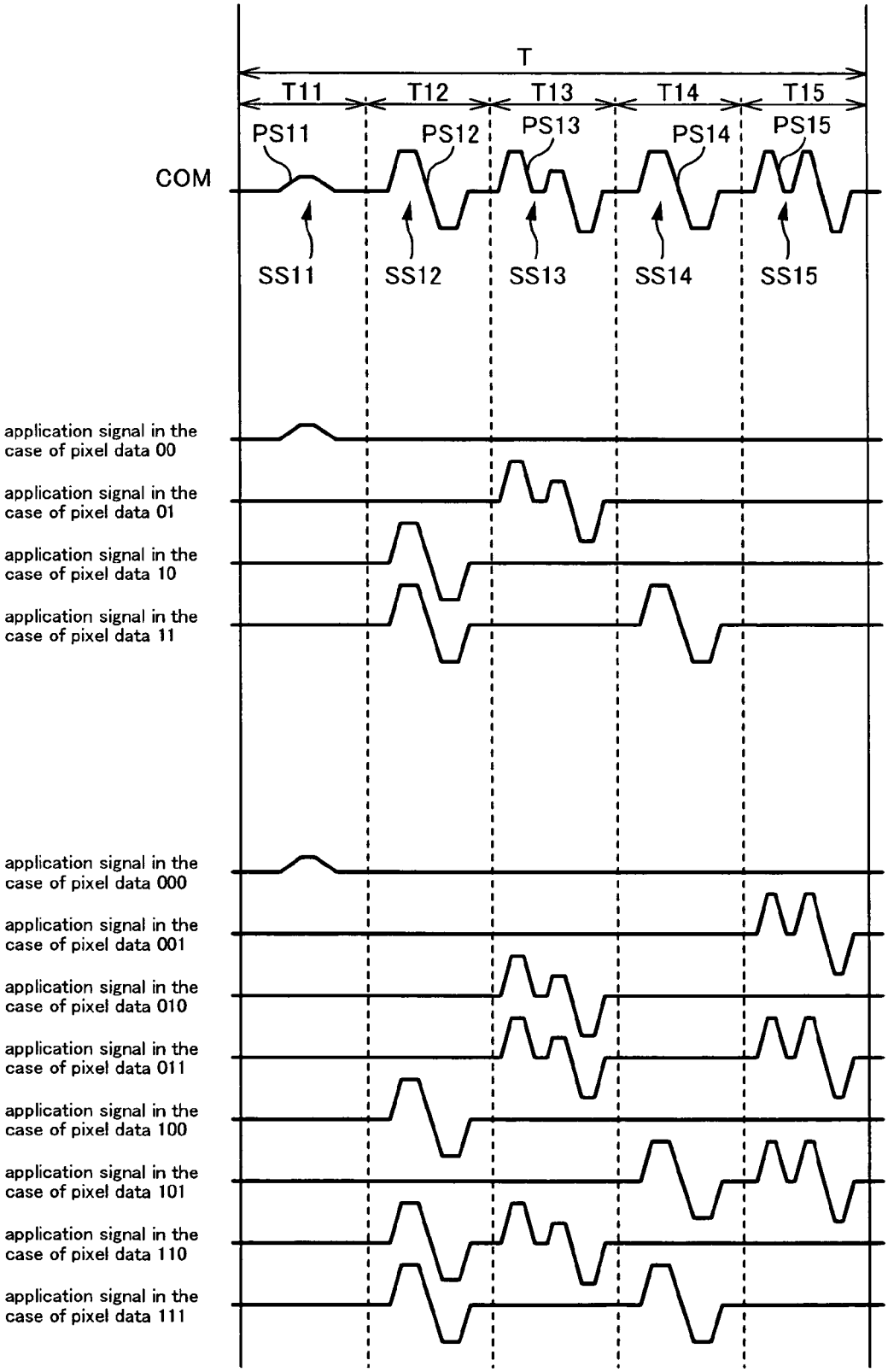
FIG. 16 is an explanatory diagram of the drive signal COM and the application signals that are applied to the piezo elements 421 of the first embodiment.

FIG. 16 is an explanatory diagram of the drive signal COM and the application signals that are applied to the piezo elements 421 in the first embodiment. FIG. 17A is a table for explaining the relationship between the pixel data and the ink droplet size at the time of four gradation printing. FIG. 17B is a table for explaining the relationship between the pixel data and the ink droplet size at the time of eight gradation printing.

The drive signal COM is repeatedly generated for each repeating period T. The repeating period T is time that is required for the carriage CR to move a predetermined distance. Each repeating period T can be divided into five intervals T11 to T15. A first interval signal SS11 that includes a drive pulse PS11 is created in the first interval T11, a second interval signal SS12 that includes a drive pulse PS12 is created in the second interval T12, a third interval signal SS13 that includes a drive pulse PS13 is created in the third interval T13, a fourth interval signal SS14 that includes a drive pulse PS14 is created in the fourth interval T14, and a fifth interval signal SS15 that includes a drive pulse PS15 is created in the fifth interval T15.

The waveforms of the drive pulses are determined based on the operation that the piezo element 421 is to perform. The waveform of the drive pulse PS11 is determined so that it causes the piezo element 421 to vibrate finely. The drive pulse PS12 and the drive pulse PS14 are determined so that they drive the piezo element 421 so as to eject a 7 pl (picoliter) ink droplet from the nozzle. The drive pulse PS13 is determined so that it drives the piezo element 421 so as to eject a 3 pl ink droplet from the nozzle. The drive pulse PS15 is determined so that it drives the piezo element 421 so as to eject a 1.5 pl ink droplet from the nozzle.

The pixel data of colors for which four gradation printing is performed are 2 bits of data per pixel. If the pixel data are 00, then the piezo element 421 is driven according to the drive pulse PS11 and the ink meniscus is finely vibrated. If the pixel data are 01, then the piezo element 421 is driven according to the drive pulse PS13 and a 3 pl ink droplet is ejected from the nozzle, forming a small dot. If the pixel data are 10, then the piezo element 421 is driven according to the drive pulse PS12 and a 7 pl ink droplet is ejected from the nozzle, forming a medium dot. If the pixel data are 11, then the piezo element 421 is driven according to the drive pulse PS12 and the drive pulse PS14 and a 14 pl ink droplet is ejected from the nozzle, forming a large dot.

The pixel data of colors for which eight gradation printing is performed are three bits of data per pixel. If the pixel data are 000, then the piezo element 421 is driven according to the drive pulse PS11 and the ink meniscus is finely vibrated. If the pixel data are 001 (the pixel data before decoding; described later), then the piezo element 421 is driven according to the drive pulse PS15 and a 1.5 pl ink droplet is ejected from the nozzle (forming a dot that corresponds to this ink amount). If the pixel data are 010, then the piezo element 421 is driven according to the drive pulse PS13 and a 3 pl ink droplet is ejected from the nozzle. If the pixel data are 011, then the piezo element 421 is driven according to the drive pulse PS3 and the drive pulse PS5, and a 4.5 pl ink droplet is ejected from the nozzle. If the pixel data are 100, then the piezo element 421 is driven according to the drive pulse PS2, and a 7 pl ink droplet is ejected from the nozzle. If the pixel data are 101, then the piezo element 421 is driven according to the drive pulse PS14 and the drive pulse PS15, and a 8.5 pl ink droplet is ejected from the nozzle. If the pixel data are 110, then the piezo element 421 is driven according to the drive pulse PS12 and the drive pulse PS13, and a 10 pl ink droplet is ejected from the nozzle. If the pixel data are 111, then the piezo element 421 is driven according to the drive pulse PS12 and the drive pulse PS14, and a 14 pl ink droplet is ejected from the nozzle.

Below, how the piezo elements 421 are driven in the above manner based on the pixel data included in the print data sent from the computer is explained.

Regarding the Decoding of the Pixel Data

The signal that is applied to a piezo element 421 when the pixel data are 00 in four gradation printing is the same as the signal that is applied to a piezo element 421 when the pixel data are 000 in eight gradation printing. Similarly, the pixel data 01 in four gradation printing and the pixel data 010 in eight gradation printing, the pixel data 10 in four gradation printing and the pixel data 100 in eight gradation printing, and the pixel data 11 in four gradation printing and the pixel data 111 in eight gradation printing, each share common signals that are applied to the piezo element 421.

Accordingly, in the first embodiment, decoding is performed so that the 3-bit pixel data for eight gradation printing, which shares an application signal with that for four gradation printing, matches the lower two digits of the pixel data for four gradation printing. Also, decoding is performed so that the upper order bit of 3-bit pixel data for eight gradation printing, which shares an application signal with that for four gradation printing, becomes 0.

FIG. 18 is an explanatory diagram regarding the decoding of the pixel data for eight gradation printing. The 3-bit pixel data of the pixel data that are included in the print data sent from the computer are decoded by a decoded prior to being input to the head controller HC of the embodiment, which is discussed later. The decoder is provided in the printer-side controller 60, but it is also possible for it to be provided on the head unit side.

For example, since the pixel data 01 for four gradation printing and the pixel data 010 for eight gradation printing share the signal that is applied to the piezo elements 421, the decoder decodes the pixel data 010 for eight gradation printing to the pixel data 001. Likewise, since the pixel data 10 for four gradation printing and the pixel data 100 for eight gradation printing share a signal that is applied to the piezo elements 421, the decoder decodes the pixel data 100 for eight gradation printing to 010. Likewise, since the pixel data 11 for four gradation printing and the pixel data 111 for eight gradation printing share a signal that is applied to the piezo elements 421, the decoder decodes the pixel data 111 for eight gradation printing to 011.

So that the values of the pixel data after decoding are not in duplicate, the decoder decodes the pixel data 001 to 100, decodes the pixel data 011 to 101, decodes the pixel data 101 to 110, and decodes the pixel data 110 to 111. It should be noted that the 3-bit pixel data for eight gradation printing that do not share an application signal with four gradation printing are decoded so that the upper order bit data becomes 1.

The values of the 3-bit pixel data before decoding are values in the shade order of the pixels on the paper. However, the result of the decoder decoding the 3-bit pixel data for eight gradation printing is that the values of the 3-bit pixel data after decoding are not in the shade order of the pixels on the paper.

By performing such decoding, the selection signals q0 to q3 at the time of eight gradation printing and the selection signals q0 to q3 at the time of four gradation printing can be made the same. As a result, it is possible to use common setting data for the setting signals q0 to q3 at the time of eight gradation printing and four gradation printing alike.

Regarding the Head Controller HC

Figure 19:
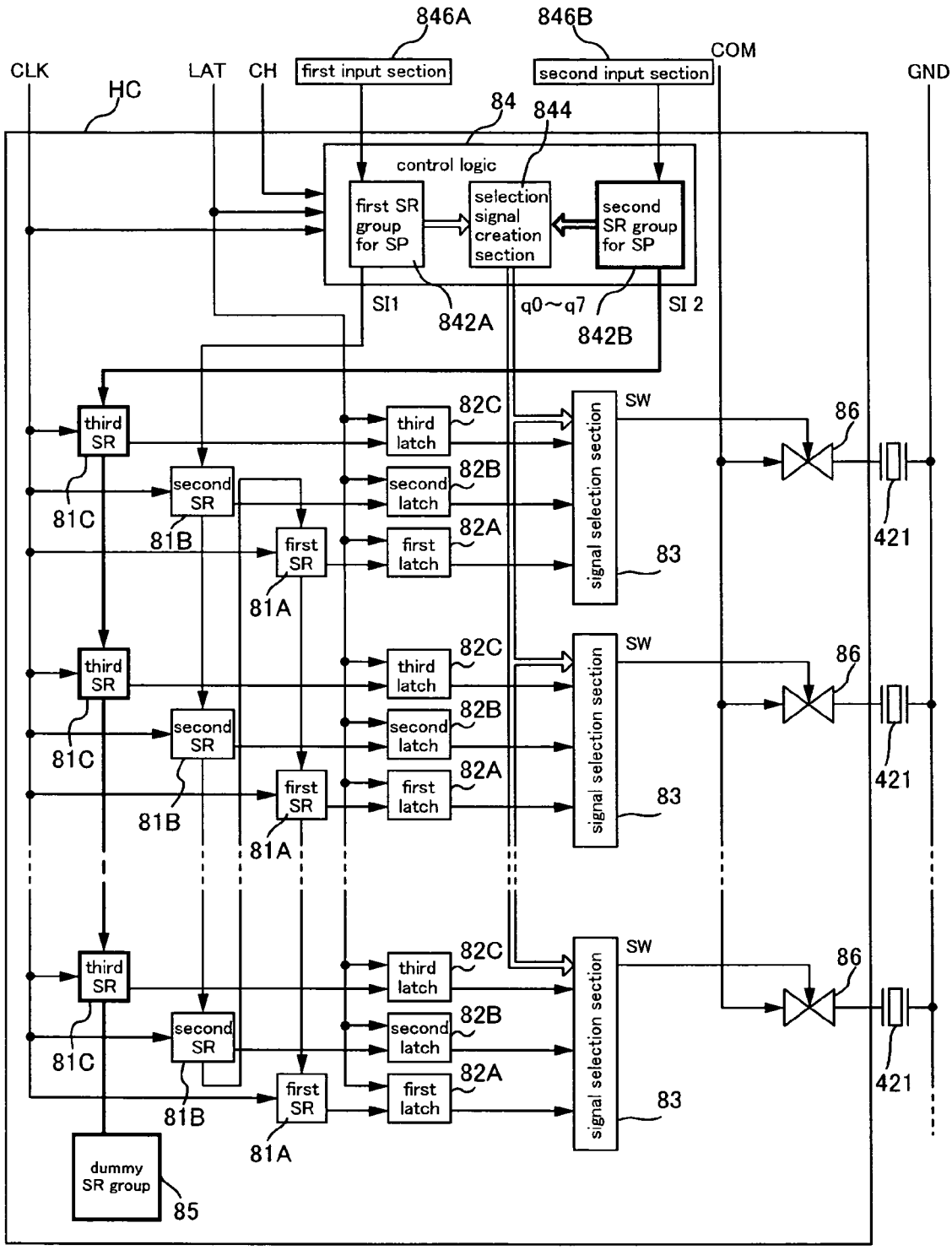
FIG. 19 is a block diagram of the head controller HC of the first embodiment.

FIG. 19 is a block diagram of the head controller HC of the first embodiment. Compared to the second reference example, the head controller HC of the first embodiment has two input sections for the setting signals that are input to the control logic 84 (first input section 846A, second input section 846B). Also, the control logic 84 of this embodiment is provided with two shift register groups for storing the setting data SP (first shift register group 842A, second shift register group 842B). The head controller HC of the first embodiment is furnished with a shift register group 85 for dummy data. The connectivity of the first shift register 81A to the third shift register 81C is different in the first embodiment from that of the second reference example. Specifically, the first shift register 81A through the second shift register 81B are connected to the first shift register group 842A, and the third shift register 81C is connected to the second shift register group 842B and the shift register group 85 for dummy data.

In the first embodiment, the head controller HC is used in common for cyan and magenta, for which eight gradation printing is performed, and for black and yellow, for which four gradation printing is performed. Eight gradation printing and four gradation printing of the first embodiment are described below.

Eight Gradation Printing (Cyan and Magenta)

Figure 20A:
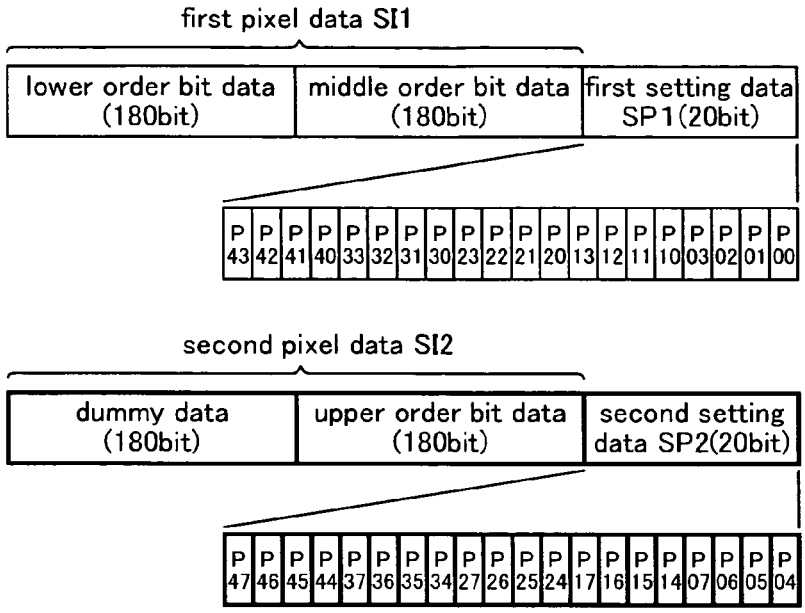
FIG. 20A is an explanatory diagram of the first setting signal that is input to the first input section and the second setting signal that is input to the second input section in the case of eight gradation printing.
Figure 20B:
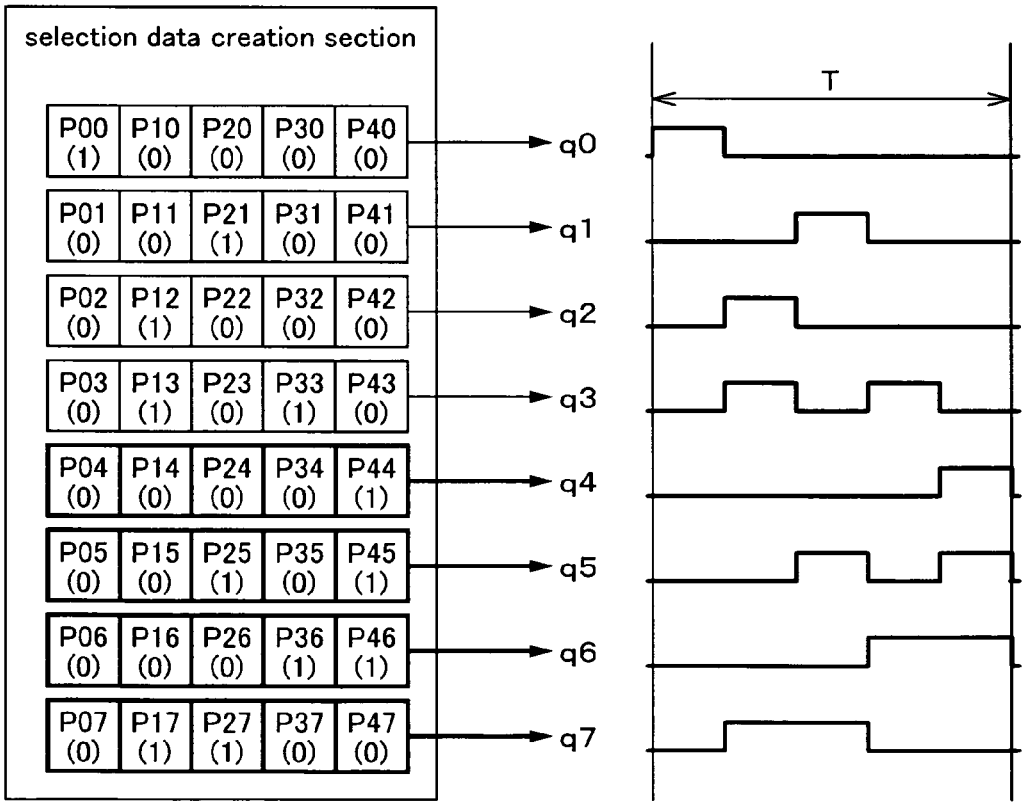
FIG. 20B is an explanatory diagram of the function of the selection signal creation section 844 in the case of eight gradation printing.

FIG. 20A is an explanatory diagram of the first setting signal that is input to the first input section 846A and the second setting signal that is input to the second input section 846B at the time of eight gradation printing. FIG. 20B is an explanatory diagram of the function of the selection signal creation section 844 at the time of eight gradation printing.

The first setting signal includes first pixel data SI1 and first setting data SP1. The first pixel data have lower order bit data and middle order bit data. The lower order bit data are the data of the lower order bit of the 180 pixel data corresponding to the 180 nozzles, and are 180 bits of data. It should be noted that in the case of the pixel data 001, the lower order bit data is 1. The middle order bit data are the data of the middle order of bit the 180 pixel data corresponding to the 180 nozzles, and are 180 bits of data. It should be noted that in the case of the pixel data 010, the middle order bit data is 1. The first setting data SP1 are the data that are required for creating the selection signals q0 to q3. It is necessary to determine whether the four types of selection signals are L level or H level in its five intervals, and thus the first setting data SP1 are 20 bits of data.

The second setting signal includes dummy data, the upper order bit data, and second setting data. The dummy data are data that are added so that the data length of the second setting signal matches the data length of the first setting signal. The upper order bit data are the data of the upper order bit of the 180 pixel data corresponding to the 180 nozzles, and are 180 bits of data. It should be noted that in the case of the pixel data 100, the upper order bit data is 1. The second setting data SP2 are the data necessary for creating the selection signals q4 to q7. It is necessary to determine whether the four types of selection signals are L level or H level in the five intervals, and thus the second setting data SP1 are made of 20 bits of data.

When the first setting signal is input to the first input section 846A, the lower order bit data are set to the first shift registers 81A, the middle order bit data are set to the second shift registers 81B, and the first setting data SP1 are set to the first shift register group 842A. When the first setting signal is input to the first input section 846A, then, in synchronization with this, the second setting signal is input to the second input section 846B. When the second setting signal is input to the second input section 846B, the dummy data are set to the dummy shift register group 85, the upper order bit data are set to the third shift registers 81C, and the second setting data SP2 are set to the second shift register group 842B.

After the various data have been set to the first shift registers 81A through the third shift registers 81C, then, in accordance with the pulse of the latch signal LAT that is input to the head controller HC, the lower order bit data that have been set in the first shift registers 81A are latched by the first latch circuits 82A, the middle order bit data that have been set in the second shift registers 81B are latched by the second latch circuits 82B, and the upper order bit data that have been set in the third shift registers 81C are latched by the third latch circuits 82C. After the various setting data have been set in the first shift register group 842A and the second shift register group 842B, then, in accordance with the pulse of the latch signal LAT that is input to the head controller HC, the first setting data SP1 and the second setting data SP2 are latched by the selection signal creation section 844.

The selection signal creation section 844 creates the selection signals q0 to q7 based on the 40 bits of setting data that have been latched, and the change signal CH for dividing the repeating period T into five intervals. The selection signal creation section 844 creates the selection signals q0 to q3 based on the first setting data SP1 that have been latched from the first shift register group 842A, and creates the selection signals q4 to q7 based on the second setting data SP2 that have been latched from the second shift register group 842B.

For example, the selection signal creation section 844 creates the selection signal q0 based on predetermined five bits of data (data P00, data P10, data P20, data P30, data P40) included in the first setting signal. The selection signal creation section 844 creates the selection signal q1 based on five predetermined bits of data (data P01, data P11, data P21, data P31, data P41) included in the first setting signal. The selection signal creation section 844 creates the selection signal q2 based on five predetermined bits of data (data P02, data P12, data P22, data P32, data P42) included in the first setting signal. The selection signal creation section 844 creates the selection signal q3 based on five predetermined bits of data (data P03, data P13, data P23, data P33, data P43) included in the first setting signal.

Also, for example, the selection signal creation section 844 creates the selection signal q4 based on five predetermined bits of data (data P04, data P14, data P24, data P34, data P44) included in the second setting signal. The selection signal creation section 844 creates the selection signal q5 based on five predetermined bits of data (data P05, data P15, data P25, data P35, data P45) included in the second setting signal. The selection signal creation section 844 creates the selection signal q6 based on five predetermined bits of data (data P06, data P16, data P26, data P36, data P46) included in the second setting signal. The selection signal creation section 844 creates the selection signal q7 based on five predetermined bits of data (data P07, data P17, data P27, data P37, data P47) included in the second setting signal.

It should be noted that L level or H level is determined for the first interval T11 of the selection signal based on the value of the data P0* (where * is 0-7), L level or H level is determined for the second interval T12 of the selection signal based on the value of the data P1* (where * is 0-7), L level or H level is determined for the third interval T13 of the selection signal based on the value of the data P2* (where * is 0-7), L level or H level is determined for the fourth interval T14 of the selection signal based on the value of the data P3* (where * is 0-7), and L level or H level is determined for the fifth interval T15 of the selection signal based on the value of the data P4* (where * is 0-7). For example, the five bit data for the selection signal q0 (data P00, data P10, data P20, data P30, data P40) is 10000, and as a result, the selection signal q0 is H level in the first interval T11 and is L level in the second through fifth intervals T12 to T14. It should be noted that the case of the selection signal q0 applies for the selection signals q1 to q7 as well.

The signal selection section 83 selects one of the selection signals q0 to q7 according to the 3-bit pixel data latched by the first latch circuit 82A to the third latch circuit 82C. The selection signal q0 is selected if the pixel data are 000, the selection signal q1 is selected if the pixel data are 001, the selection signal q2 is selected if the pixel data are 010, the selection signal q3 is selected if the pixel data are 011, the selection signal q4 is selected if the pixel data are 100, the selection signal q5 is selected if the pixel data are 101, the selection signal q6 is selected if the pixel data are 110, and the selection signal q7 is selected if the pixel data are 111. It should be noted that if the upper order bit of the 3-bit pixel data (the pixel data after decoding) is 0, then one of the selection signals q0 to q3 is selected. Also, if the upper order bit of the 3-bit pixel data (the pixel data after decoding) is 1, then one of the selection signals q4 to q7 is selected. The selection signal that has been selected is then output from the signal selection section 83 as the switch signal SW.

The drive signal COM and the switch signal SW are input to the switch 86. When the switch signal is H level, the switch 86 becomes on and the drive signal COM is applied to the piezo element 421. When the switch signal SW is L level, the switch 86 becomes off and the drive signal COM is not applied to the piezo element 421.

If the pixel data before decoding are 000, then the signal selection section 83 selects the selection signal q0 based on the decoded pixel data of 000, and the first interval signal SS11 of the drive signal COM is applied to the piezo element 421 and the piezo element 421 is driven by the drive pulse PS11. When the piezo element 421 is driven according to the drive pulse PS11, the ink is subjected to a change in pressure of a degree that does not result in the ejection of ink, and the ink meniscus (the free surface of the ink that is exposed at the nozzle portion) is finely vibrated.

If the pixel data before decoding are 001, then the signal selection section 83 selects the selection signal q4 based on the decoded pixel data of 100, and the fifth interval signal SS15 of the drive signal COM is applied to the piezo element 421 and the piezo element 421 is driven by the drive pulse PS15. When the piezo element 421 is driven according to the drive pulse PS15, a 1.5 pl (picoliter) ink droplet is ejected (and forms a dot that corresponds to that amount of ink).

If the pixel data before decoding are 010, then the signal selection section 83 selects the selection signal q1 based on the decoded pixel data of 001, and the third interval signal SS13 of the drive signal COM is applied to the piezo element 421 and the piezo element 421 is driven by the drive pulse PS13. When the piezo element 421 is driven according to the drive pulse PS13, a 3 pl ink droplet is ejected.

If the pixel data before decoding are 011, then the signal selection section 83 selects the selection signal q5 based on the decoded pixel data of 101, and the third interval signal SS13 and the fifth interval signal SS15 of the drive signal COM are applied to the piezo element 421 and the piezo element 421 is driven by the drive pulse PS13 and the drive pulse PS15. When the piezo element 421 is driven according to the drive pulse PS13 and the drive pulse PS15, a 4.5 pl ink droplet is ejected.

If the pixel data before decoding are 100, then the signal selection section 83 selects the selection signal q2 based on the decoded pixel data of 010, and the second interval signal SS12 of the drive signal COM is applied to the piezo element 421 and the piezo element 421 is driven by the drive pulse PS12. When the piezo element 421 is driven according to the drive pulse PS12, a 7 pl ink droplet is ejected.

If the pixel data before decoding are 101, then the signal selection section 83 selects the selection signal q6 based on the decoded pixel data of 110, and the fourth interval signal SS14 and the fifth interval signal SS15 of the drive signal COM are applied to the piezo element 421 and the piezo element 421 is driven by the drive pulse PS14 and the drive pulse PS15. When the piezo element 421 is driven according to the drive pulse PS14 and the drive pulse PS15, a 8.5 pl ink droplet is ejected.

If the pixel data before decoding are 110, then the signal selection section 83 selects the selection signal q7 based on the decoded pixel data of 111, and the second interval signal SS12 and the third interval signal SS13 of the drive signal COM are applied to the piezo element 421 and the piezo element 421 is driven by the drive pulse PS12 and the drive pulse PS13. When the piezo element 421 is driven according to the drive pulse PS12 and the drive pulse PS13, a 10 pl ink droplet is ejected.

If the pixel data before decoding are 111, then the signal selection section 83 selects the selection signal q3 based on the decoded pixel data of 011, and the second interval signal SS12 and the fourth interval signal SS14 of the drive signal COM are applied to the piezo element 421 and the piezo element 421 is driven by the drive pulse PS12 and the drive pulse PS14. When the piezo element 421 is driven according to the drive pulse PS12 and the drive pulse PS14, a 14 pl ink droplet is ejected.

Four Gradation Printing (Black and Yellow)

Figure 21A:
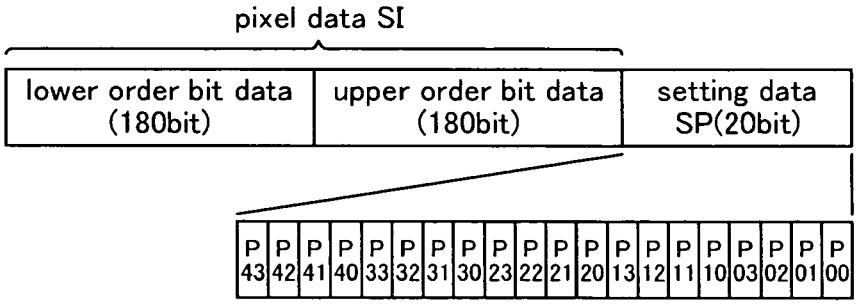
FIG. 21A is an explanatory diagram of the setting signal that is input to the first input section at the time of four gradation printing.
Figure 21B:
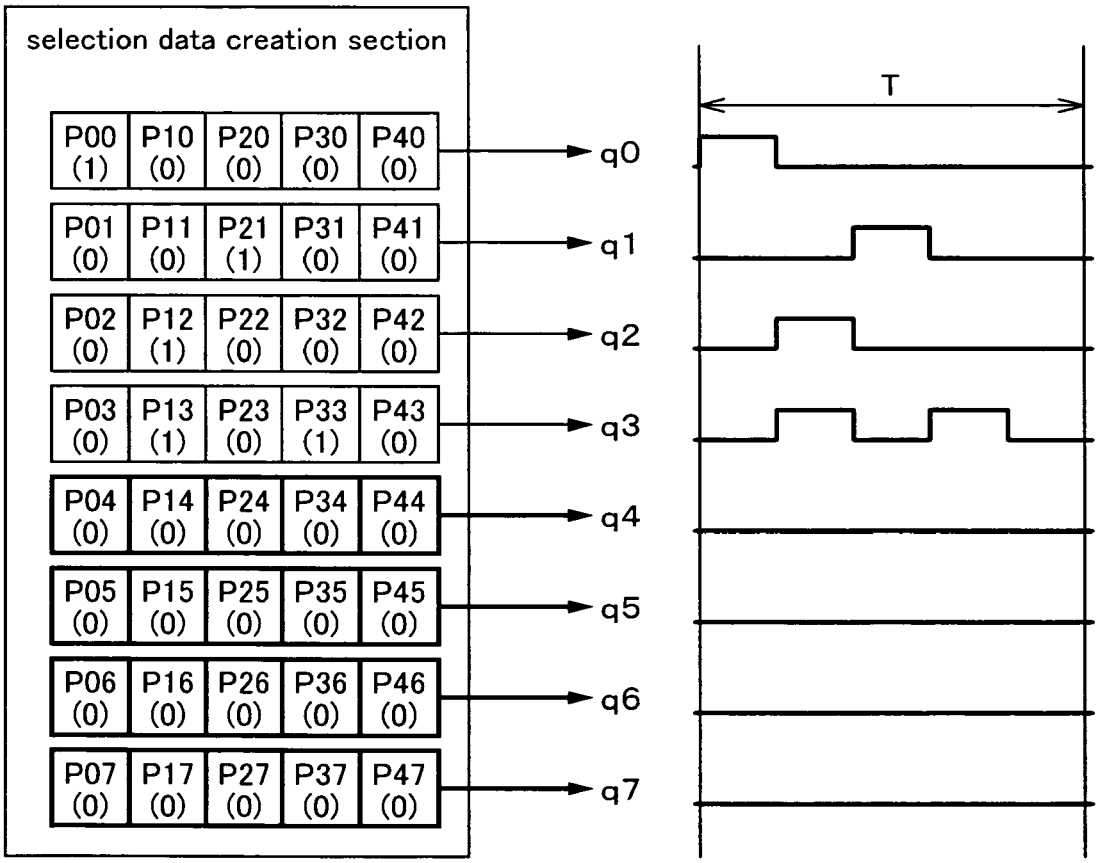
FIG. 21B is an explanatory diagram of the function of the selection signal creation section 844 at the time of four gradation printing.

FIG. 21A is an explanatory diagram of the setting signal that is input to the first input section 846A at the time of four gradation printing. FIG. 21B is an explanatory diagram of the function of the selection signal creation section 844 in the case of four gradation printing.

The second input section 846B of the color head controllers HC that perform four gradation printing is connected to the GND, and the potential of the second input section 846B is L level.

The setting signal includes pixel data SI and setting data SP. The pixel data have lower order bit data and upper order bit data. The lower order bit data are the data of the lower order bit of the 180 pixel data that correspond to the 180 nozzles, and are 180 bits of data. It should be noted that in the case of the pixel data 01, the data of the lower order bit is 1. The upper order bit data are data of the upper order bit of the 180 pixel data that correspond to the 180 nozzles, and are 180 bits of data. It should be noted that in the case of the pixel data 10, the upper order bit data is 1. The setting data SP are data required for creating the selection signals q0 to q3. It is necessary to determine whether four types of selection signals are L level or H level in the five intervals, and thus the setting data SP are 20 bits of data.

When the setting signal is input to the first input section 846A, the lower order bit data are set in the first shift registers 81A, the upper order bit data are set in a second shift registers 81B, and the setting data SP are set in the first shift register group 842A. When the setting signal is input to the first input section 846A, the second input section 846B is connected to the GND and is at the L level potential. Thus, a 0 (L level data) is set in the third shift registers 81C, and the data of the L level is set to the second shift register group 842B as well.

Once the various data have been set in the first shift registers 81A through the third shift register 81C, then, according to the pulse of the latch signal LAT that is input to the head controller HC, the lower order bit data that have been set in the first shift registers 81A are latched by the first latch circuits 82A, and the upper order bit data that have been set in the second shift registers 81B are latched by the second latch circuits 82B. At this time, the L level data that have been set in the third shift registers 81C are latched by the third latch circuits 82C. After the setting data SP have been set in the first shift register group 842A, then, according to the pulse of the latch signal LAT that is input to the head controller HC, the setting data SP are latched by the selection signal creation section 844. Also at this time, the L level data that have been set in the second shift register group 842B are latched by the selection signal creation section 844.

The selection signal creation section 844 creates the selection signals q0 to q3 based on the setting data SP latched from the first shift register group 842A. In this way, the selection signal creation section 844 creates the selection signals q0 to q3 in the same manner as in the case of eight gradation printing.

Also in the same manner as in the case of eight gradation printing, the selection signal creation section 844 creates the selection signals q4 to q7 based on the data latched from the second shift register group 842B. However, since the data that are latched from the second shift register group 842B are L level, the selection signals q4 to q7 become L level in all intervals from the first interval T11 through the fifth interval T15.

When the data that are latched by the first latch circuit 82A to the third latch circuit 82C are seen from the signal selection section 83, the 3-bit pixel data have an upper order bit data of 0. Then, in the same manner as in the case of eight gradation printing, the signal selection section 83 selects one of the selection signals q0 to q7 in accordance with the 3-bit pixel data latched by the first latch circuit 82A through the third latch circuit 82C. However, since the upper order bit data is 0 when seen from the signal selection section 83, the selection signals q4 to q7 are not selected by the signal selection section 83. Thus, in practical terms, the signal selection section 83 selects one of the selection signals q0 to q3.

If the pixel data are 00, then the signal selection section 83 selects the selection signal q0 based on the 3-bit data 000 latched by the first latch circuit 82A through the third latch circuit 82C, and the first interval signal SS11 of the drive signal COM is applied to the piezo element 421 and the piezo element 421 is driven by the drive pulse PS11. When the piezo element 421 is driven according to the drive pulse PS11, the ink is subjected to a change in pressure of a degree that does not result in the ejection of ink, and the ink meniscus (the free surface of the ink that is exposed at the nozzle portion) is finely vibrated.

If the pixel data are 01, then the signal selection section 83 selects the selection signal q1 based on the 3-bit data 001 latched by the first latch circuit 82A to the third latch circuit 82C, and the third interval signal SS13 of the drive signal COM is applied to the piezo element 421 and the piezo element 421 is driven by the drive pulse PS13. When the piezo element 421 is driven according to the drive pulse PS13, a 3 pl ink droplet is ejected.

If the pixel data are 10, then the signal selection section 83 selects the selection signal q2 based on the 3-bit data 010 latched by the first latch circuit 82A to the third latch circuit 82C, and the second interval signal SS12 of the drive signal COM is applied to the piezo element 421 and the piezo element 421 is driven by the drive pulse PS12. When the piezo element 421 is driven according to the drive pulse PS12, a 7 pl ink droplet is ejected.

If the pixel data are 11, then the signal selection section 83 selects the selection signal q3 based on the 3-bit data 011 latched by the first latch circuit 82A to the third latch circuit 82C, and the second interval signal SS12 and the fourth interval signal SS14 of the drive signal COM are applied to the piezo element 421 and the piezo element 421 is driven by the drive pulse PS12 and the drive pulse PS14. When the piezo element 421 is driven according to the drive pulse PS12 and the drive pulse PS14, a 14 pl ink droplet is ejected.

It should be noted that since the upper order bit data of the 3-bit pixel data is 0 when seen from the signal selection section 83, the selection signals q4 to q7, which are L level in all intervals, are not selected by the signal selection section 83.

In this way, according to the first embodiment, the head controllers HC for black and yellow, for which four gradation printing is performed, can share a common structure with the head controllers for cyan and magenta, for which eight gradation printing is performed. Also, since the amount of data of the setting signal that is serially transferred to the first input section 846A and the second input section 846B of the head controller HC is less than in the case of the second reference example, the setting of data is not time consuming.

Second Embodiment (Mixed Printing of Four Gradations and Six Gradations)

In the first embodiment described above, eight gradation printing is performed for cyan and magenta, but in the second embodiment described below, six gradation printing is performed for cyan and magenta. Also, in the first embodiment described above, the setting data for creating the selection signals q0 to q3 are input from only the first input section 846A, but in the second embodiment described below, some of the setting data for creating the selection signals q0 to q3 is input from the second input section 846B.

Regarding Decoding the Pixel Data

The signal that is applied to the piezo element 421 when the pixel data are 00 in four gradation printing is the same as the signal that is applied to the piezo element 421 when the pixel data are 000 in six gradation printing. Similarly, the pixel data 01 in four gradation printing and the pixel data 010 in six gradation printing, the pixel data 10 in four gradation printing and the pixel data 011 in six gradation printing, and the pixel data 11 in four gradation printing and the pixel data 101 in six gradation printing, each share common signals that are applied to the piezo elements 421.

Accordingly, in the second embodiment as well, decoding is performed so that the 3-bit pixel data for six gradation printing, which shares an application signal with that for four gradation printing, matches the lower two digits of the pixel data for four gradation printing. Also, decoding is performed so that the upper order bit of the 3-bit pixel data for six gradation printing, which shares the application signal with that for four gradation printing, becomes 0.

FIG. 22 is an explanatory diagram regarding the decoding of the pixel data for six gradation printing. The 3-bit pixel data of the pixel data that are included in the print data sent from the computer are decoded by a decoder prior to being input to the head controller HC of the embodiment, which is discussed later. The decoder is provided in the printer-side controller 60, but it is also possible for it to be provided on the head unit side.

The values of the 3-bit pixel data before decoding are values in the shade order of the pixels on the paper. However, the result of the decoder decoding the 3-bit pixel data for six gradation printing is that the values of the 3-bit pixel data after decoding are not in the shade order of the pixels on the paper.

In this embodiment as well, a common head controller HC is used for cyan and magenta, for which six gradation printing is performed, and for black and yellow, for which four gradation printing is performed. Below is a description of six gradation printing and four gradation printing in the second embodiment. It should be noted that the structure of the head controller HC of the second embodiment is substantially the same as the structure of the head controller HC of the first embodiment, and thus FIG. 19 will be referred to as necessary in the description.

Six Gradation Printing (Cyan and Magenta)

Figure 23A:
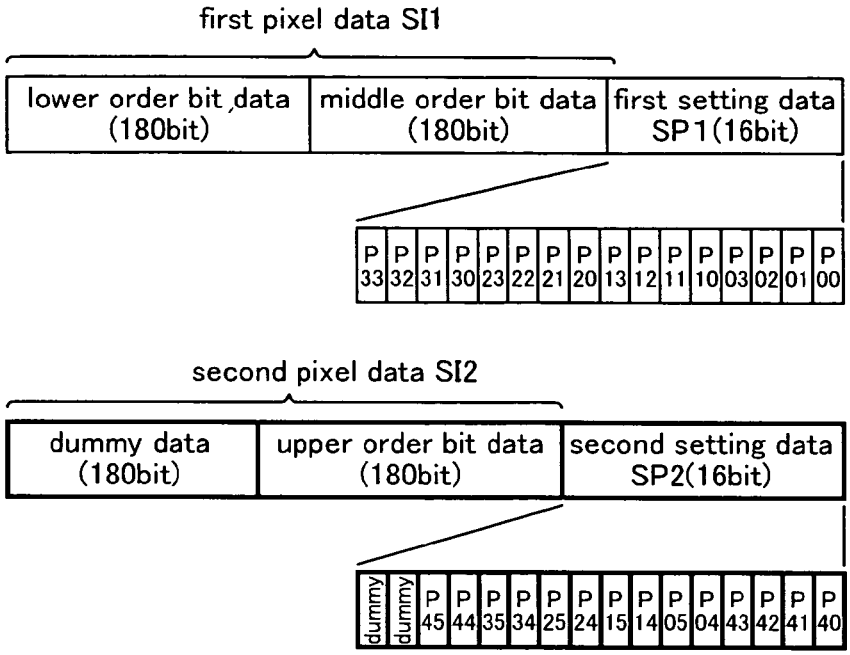
FIG. 23A is an explanatory diagram of the first setting signal that is input to the first input section and the second setting signal that is input to the second input section at the time of six gradation printing.
Figure 23B:
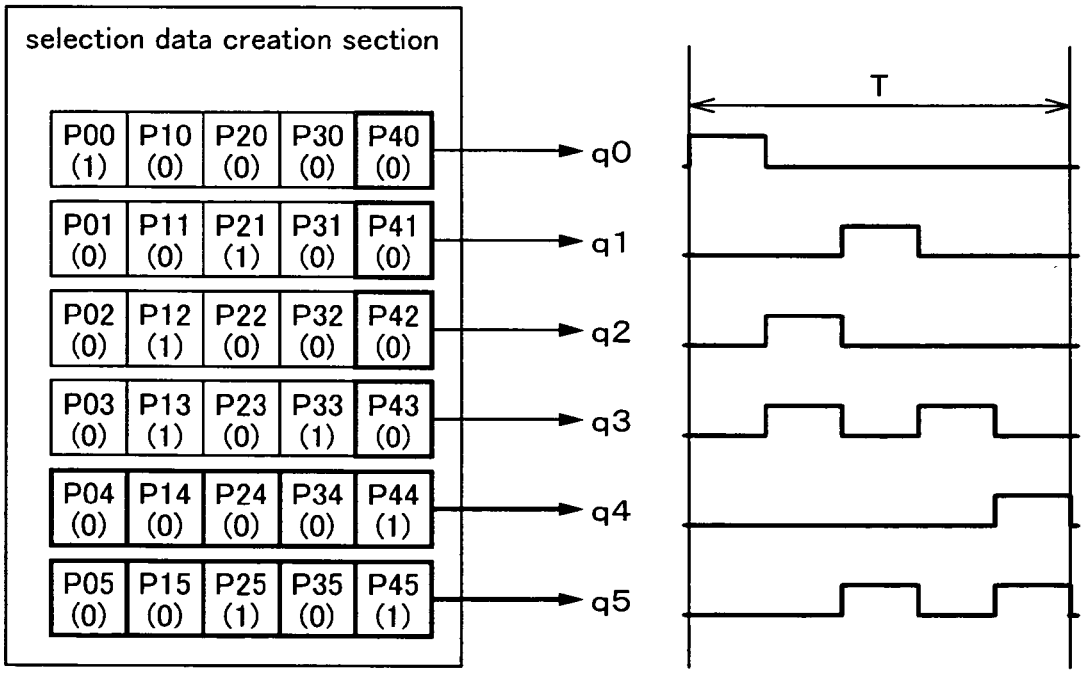
FIG. 23B is an explanatory diagram of the function of the selection signal creation section 844 at the time of six gradation printing.

FIG. 23A is an explanatory diagram of the first setting signal that is input to the first input section 846A and the second setting signal that is input to the second input signal 846B in the case of six gradation printing. FIG. 23B is an explanatory diagram of the function of the selection signal creation section 844 at the time of six gradation printing.

Like in the first embodiment, the first setting signal includes first pixel data SI1 and first setting data SP1. However, the first setting data SP1 of the second embodiment are 16 bits of data, and are data for determining whether the selection signals q0 to q3 are L level or H level in the first interval T11 through the fourth interval T14.

The second setting signal, also like in the first embodiment, includes dummy data, upper order bit data, and second setting data. However, the second setting data SP2 of the second embodiment are 16 bits of data that include two bits of dummy data. The second setting data SP2 are made of data for determining whether the selection signals q0 to q3 are L level or H level in the fifth interval T15, and data for determining whether the selection signals q4 and q5 are L level of H level in the five intervals.

As in the first embodiment, in the second embodiment as well, the first setting signal is input to the first input section 846A and the second setting signal is input to the second input section 846B (see FIG. 19). Thus, like in the first embodiment, the various data are set in the shift registers and are latched according to the pulse of the latch signal LAT.

The selection signal creation section 844 creates selection signals q0 to q5 based on the 30 bits of latched setting data and the change signal CH for dividing the repeating period T into five intervals. In the first embodiment, the selection signals q0 to q3 are created based on only the first setting data SP1, but in the second embodiment, they are created based on the first setting data SP1 and the second setting data SP2.

For example, the selection signal creation section 844 creates the selection signal q0 based on data P00, data P10, data P20, data P30, and data P40. It should be noted that the data P00 to data P30 are data that are included in the first setting signal, but the data P40 are data that are included in the second setting signal. Similarly, the selection signal creation section 844 creates selection signals q1 to q3 based on the four bits of data included in the first setting signal and the one bit of data included in the second setting signal.

It should be noted that as in the first embodiment, the selection signals q4 to q5 are created based on predetermined five bits of data that are included in the second setting signal.

The signal selection section 83, like in the first embodiment, selects one of the selection signals q0 to q5 according to the three bits of pixel data latched by the first latch circuit 82A through the third latch circuit 82C. The selection signal q0 is selected if the pixel data are 000, the selection signal q1 is selected if the pixel data are 001, the selection signal q2 is selected if the pixel data are 010, the selection signal q3 is selected if the pixel data are 011, the selection signal q4 is selected if the pixel data are 100, and the selection signal q5 is selected if the pixel data are 101. It should be noted that if the upper order bit data of the three bits of pixel data (the pixel data after decoding) is 0, then one of the selection signals q0 to q3 is selected. If the upper order bit of the three bits of pixel data (the pixel data after decoding) is 1, then either selection signal q4 to q5 is selected.

Thus, the ink meniscus is finely vibrated if the pixel data before decoding are 000, a 1.5 pl ink droplet is ejected if the pixel data before decoding are 001, a 3 pl ink droplet is ejected if the pixel data before decoding are 010, a 7 pl ink droplet is ejected if the pixel data before decoding are 011, a 10 plink droplet is ejected if the pixel data before decoding are 100, and a 14 pl ink droplet is ejected if the pixel data before decoding are 101.

Four Gradation Printing (Black and Yellow)

Figure 24A:
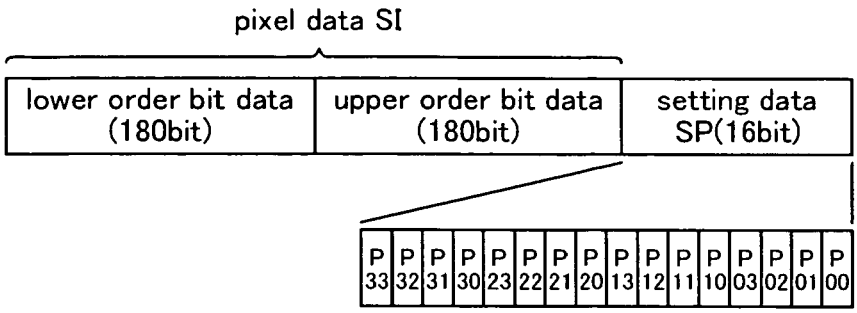
FIG. 24A is an explanatory diagram of the setting signal that is input to the first input section at the time of four gradation printing.
Figure 24B:
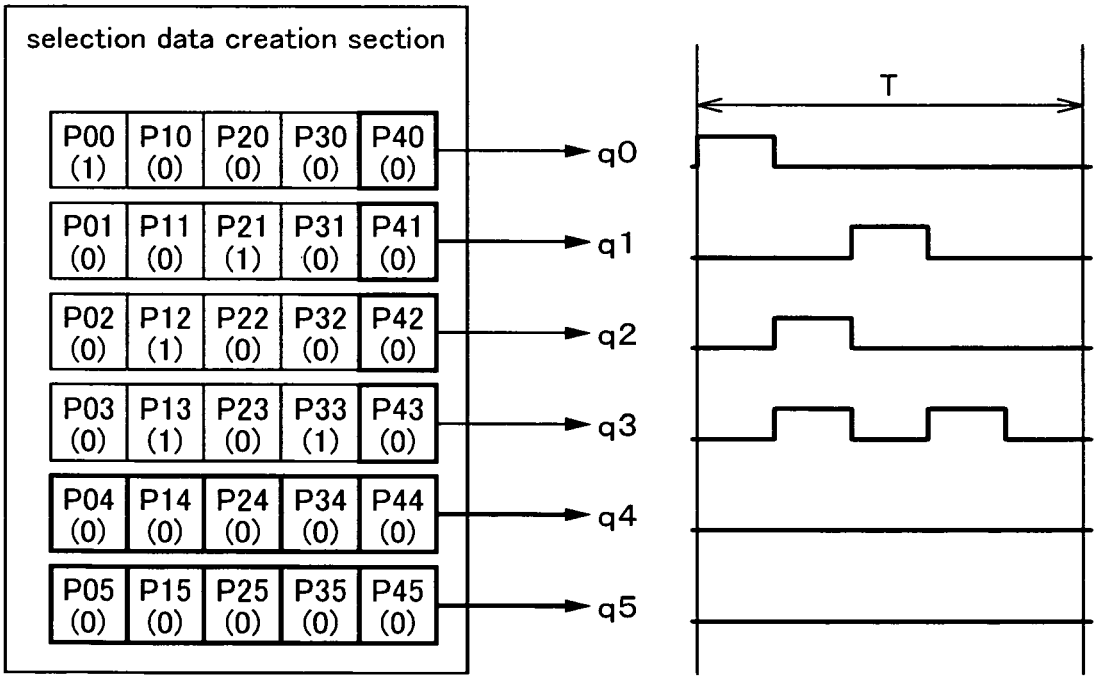
FIG. 24B is an explanatory diagram of the function of the selection signal creation section 844 at the time of four gradation printing.

FIG. 24A is an explanatory diagram of the setting signal that is input to the first input section 846A at the time of four gradation printing. FIG. 24B is an explanatory diagram of the function of the selection signal creation section 844 in the case of four gradation printing.

In the second embodiment, like in the first embodiment, the second input section 846B of the color head controllers HC that perform four gradation printing is connected to the GND, and the potential of the second input section 846B is L level. Thus, when the setting signal is input to the first input section 846A, L level data are set in the third shift registers 81C and the second shift register group 842B. Then, in correspondence with the pulse of the latch signal LAT, the L level data set in the third shift registers 81C are latched by the third latch circuits 82C, and the L level data set in the second shift register group 842B are latched by the selection signal creation section 844.

The selection signal creation section 844, when it creates the selection signals q0 to q3, sets the first interval T11 through the fourth interval T14 to L level or H level according to the setting data. The selection signal creation section 844 sets the fifth interval T15 of the selection signals q0 to q3 to the L level according to the L level data from the second shift register group 842B. Thus, the selection signal creation section 844 creates the same selection signals q0 to q3 as in six gradation printing.

The selection signal creation section 844, like in the case of six gradation printing, creates selection signals q4 and q5 based on the data latched from the second shift register group 842B. However, since the data latched from the second shift register group 842B are L level, the selection signals q4 and q5 become L level in all intervals from the first interval T11 through the fifth interval T15.

When the data that are latched by the first latch circuit 82A through the third latch circuit 82C are seen from the signal selection section 83, the three bits of pixel data have upper order bit data of 0. Then, in the same manner as in the case of six gradation printing, the signal selection section 83 selects one of the selection signals q0 to q5 in accordance with the three bits of pixel data latched by the first latch circuit 82A through the third latch circuit 82C. However, since the upper order bit data is 0 when seen from the signal selection section 83, the selection signals q4 and q5 are not selected by the signal selection section 83. Thus, in practical terms, the signal selection section 83 selects one signal from the selection signals q0 to q3.

Thus, the ink meniscus is finely vibrated if the pixel data are 00, a 3 pl ink droplet is ejected if the pixel data are 01, a 7 pl ink droplet is ejected if the pixel data are 10, and a 14 pl ink droplet is ejected if the pixel data are 11.

In this way, with the second embodiment, as in the first embodiment discussed above, it is possible to use a common head controller HC for four gradation printing and six gradation printing. Also, as in the first embodiment discussed above, the amount of data of the setting signals serially transferred to the first input section 846A and the second input section 846B of the head controller HC is less than in the second reference example, and thus the setting of data is not time consuming.

Also, with the second embodiment, the selection signals q0 to q3 are determined to be L level or H level based on not only the setting data that are input to the first input section 846A but also the signal that is input to the second input section 846B. Thus, the amount of setting data to be input to the first input section 846A can be reduced, and thus, in the second embodiment, the time that is required for setting the data can be shortened over that in the first embodiment.

Third Embodiment (A Case of Using Two Types of Drive Signals COM)

In the first embodiment and the second embodiment discussed earlier, there was only a single type of drive signal COM, but in the third embodiment described below, there are two types of drive signals COM. Since it is possible to include two types of drive signal COM with drive pulses having different waveforms, in the third embodiment the repeating period T is shorter than the repeating periods of the first embodiment and the second embodiment.

It should be noted that in the third embodiment, as in the second embodiment, six gradation printing is performed for cyan and magenta and four gradation printing is performed for black and yellow. For this reason, the pixel data are decoded in the third embodiment in the same way as in the second embodiment (see FIG. 22).

Regarding the Relationship Between the Pixel Data and the Ink Droplet Size

Figure 25:
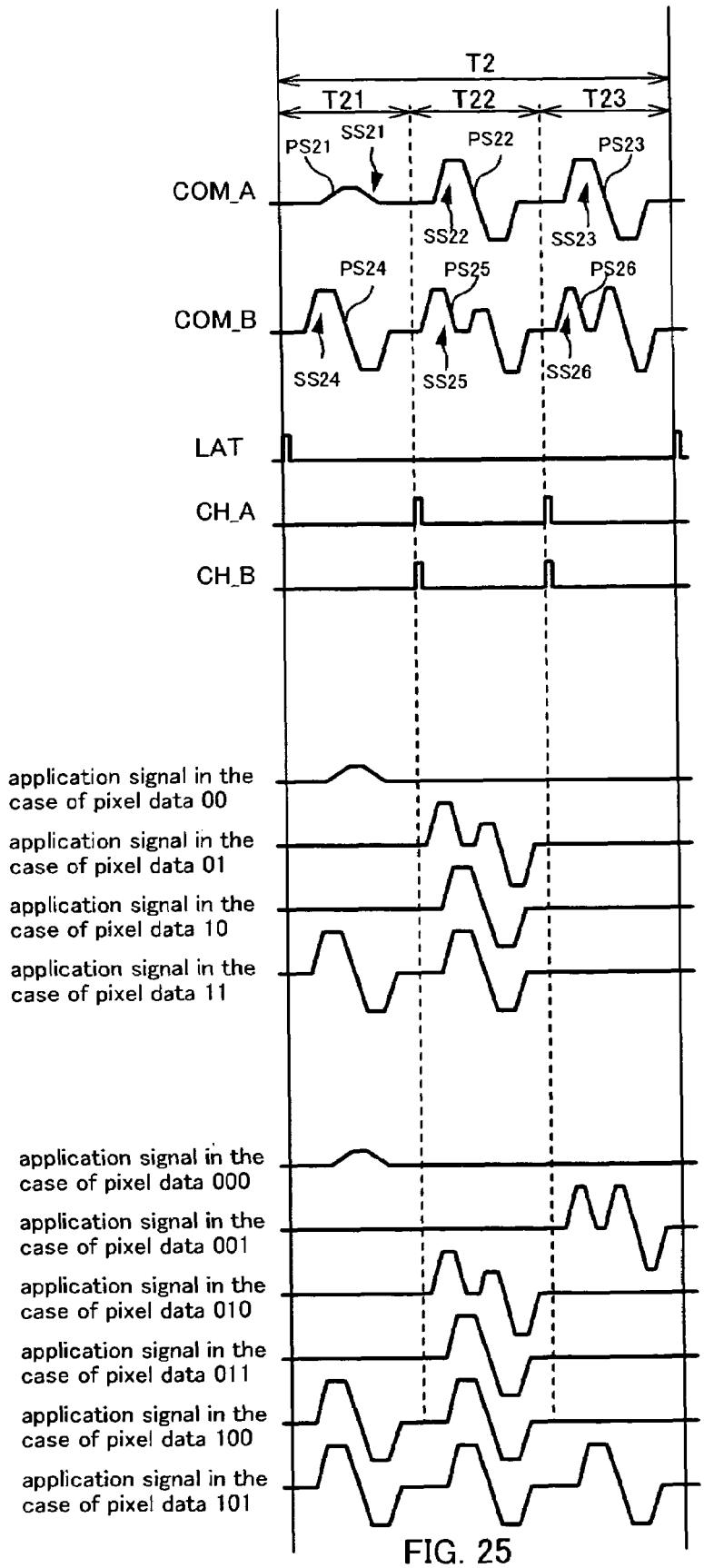
FIG. 25 is an explanatory diagram of the drive signal COM and the application signals that are applied to the piezo elements 421 of the third embodiment.

FIG. 25 is an explanatory diagram of the drive signal COM and the application signals that are applied to the piezo elements 421 in the third embodiment.

The first drive signal COM_A and the second drive signal COM_B are repeatedly generated for each repeating period T2. The repeating period T2 is the period that is required for the carriage CR to move a predetermined distance. Each repeating period T2 can be divided into three intervals T21 to T23.

With the first drive signal COM_A, a first interval signal SS21 that includes a drive pulse PS21 is created in the first interval T21, a second interval signal SS22 that includes a drive pulse PS22 is created in the second interval T22, and a third interval signal SS23 that includes a drive pulse PS23 is created in the third interval T23. With the second drive signal COM_B, a first interval signal SS24 that includes a drive pulse PS24 is created in the first interval T21, a second interval signal SS25 that includes a drive pulse PS25 is created in the second interval T22, and a third interval signal SS26 that includes a drive pulse PS26 is created in the third interval T23.

The waveforms of the drive pulses have been determined based on the operation that the piezo element 421 is to perform. The waveform of the drive pulse PS21 is determined so that it causes the piezo element 421 to vibrate finely. The drive pulse PS22, the drive pulse PS23, and the drive pulse PS24 are determined so that they drive the piezo element 421 so as to eject a 7 pl (picoliter) ink droplet from the nozzle. The drive pulse PS25 is determined so that it drives the piezo element 421 so as to eject a 3 pl ink droplet from the nozzle. The drive pulse PS26 is determined so that it drives the piezo element 421 so as to eject a 1.5 pl ink droplet from the nozzle.

The pixel data of colors for which four gradation printing is performed are two bits of data per pixel. If the pixel data are 00, then the piezo element 421 is driven according to the drive pulse PS21 and the ink meniscus is finely driven. If the pixel data are 01, then the piezo element 421 is driven according to the drive pulse PS25 and a 3 pl ink droplet is ejected from the nozzle, forming a small dot. If the pixel data are 10, then the piezo element 421 is driven according to the drive pulse PS22 and a 7 pl ink droplet is ejected from the nozzle, forming a medium dot. If the pixel data are 11, then the piezo element 421 is driven according to the drive pulse PS22 and the drive pulse PS24 and a 14 pl ink droplet is ejected from the nozzle, forming a large dot.

The pixel data of colors for which six gradation printing is performed are three bits of data per pixel. If the pixel data are 000, then the piezo element 421 is driven according to the drive pulse PS21 and the ink meniscus is finely vibrated. If the pixel data (the pixel data before decoding, described later) are 001, then the piezo element 421 is driven according to the drive pulse PS26 and a 1.5 pl ink droplet is ejected from the nozzle, forming a tiny dot. If the pixel data are 010, then the piezo element 421 is driven according to the drive pulse PS25 and a 3 pl ink droplet is ejected from the nozzle, forming a small dot. If the pixel data are 011, then the piezo element 421 is driven according to the drive pulse PS22, and a 7 pl ink droplet is ejected from the nozzle, forming a medium dot. If the pixel data are 100, then the piezo element 421 is driven according to the drive pulse PS22 and the drive pulse PS24, and a 14 pl ink droplet is ejected from the nozzle, forming a large dot. If the pixel data are 101, then the piezo element 421 is driven according to the drive pulse PS22, the drive pulse PS24, and the drive pulse PS23, and a 21 pl ink droplet is ejected from the nozzle, forming an extra large dot.

Below, how the piezo elements 421 are driven in the above manner based on the pixel data included in the print data sent from the computer is explained.

Regarding the Decoding of the Pixel Data

The signal that is applied to a piezo element 421 when the pixel data are 00 in four gradation printing is the same as the signal that is applied to a piezo element 421 when the pixel data are 000 in six gradation printing. Similarly, the pixel data Olin four gradation printing and the pixel data 010 in six gradation printing, the pixel data 10 in four gradation printing and the pixel data 011 in six gradation printing, and the pixel data 11 in four gradation printing and the pixel data 100 in six gradation printing, each share common signals that are applied to the piezo element 421.

Accordingly, in the first embodiment, decoding is performed so that the three bits of pixel data for eight gradation printing, which shares an application signal with that for four gradation printing, match the lower two digits of the pixel data for four gradation printing. Decoding also is performed so that the upper order bit of three bits of pixel data for eight gradation printing, which shares the application signal with that for four gradation printing, becomes 0.

FIG. 26 is an explanatory diagram regarding the decoding of the pixel data for six gradation printing. The three bits of pixel data of the pixel data that are included in the print data sent from the computer are decoded by a decoder prior to being input to the head controller HC of the embodiment, which is discussed later. The decoder is provided in the printer-side controller 60, but it is also possible for it to be provided on the head unit side.

The values of the 3-bit pixel data before decoding are values in the shade order of the pixels on the paper. However, the result of the decoder decoding the 3-bit pixel data for six gradation printing is that the values of the 3-bit pixel data after decoding are not values in the shade order of the pixels on the paper.

Regarding the Head Controller HC

Figure 27:
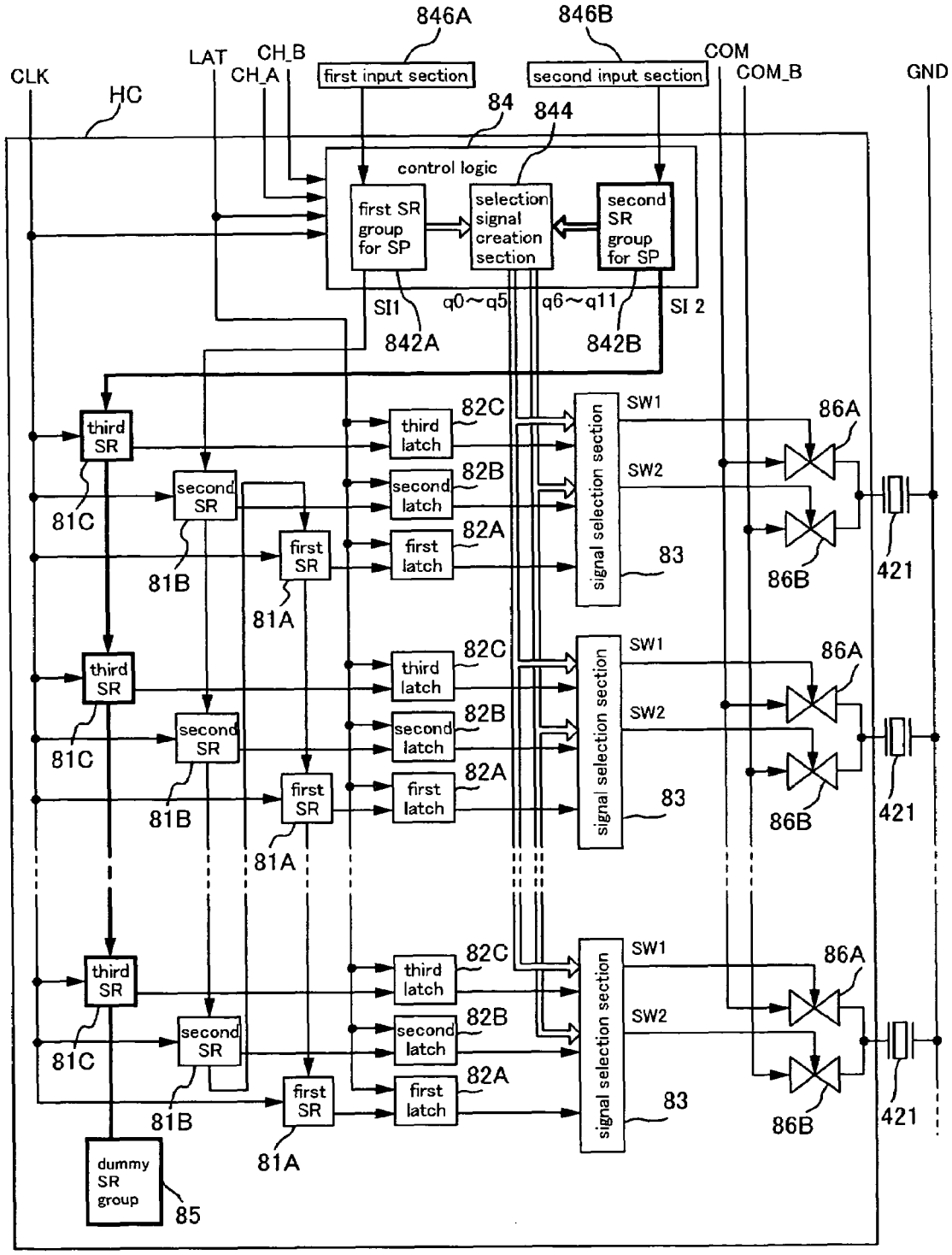
FIG. 27 is a block diagram of the head controller HC of the third embodiment.

FIG. 27 is a block diagram of the head controller HC of the third embodiment. In comparison to the first embodiment, in the third embodiment two types of change signals (first change signal CH_A and the second change signal CH_B) are input to the head controller HC (more specifically, to the control logic 84). Also in the third embodiment, two types of drive signals (first drive signal COM_A and second drive signal COM_B) are input to the head controller HC. Each piezo element 421 is provided with two switches (a first switch 86A and a second switch 86B), and the first drive signal COM_A is input to one switch and the second drive signal COM_B is input to the other switch. The signal selection sections output two switch signals (a first switch signal SW_A and a second switch signal SW_B), where one switch signal is input to the first switch 86A and the other switch signal is input to the second switch 86B.

In the third embodiment as well, a common head controller HC is used for cyan and magenta, for which six gradation printing is performed, and for black and yellow, for four gradation printing. Below, six gradation printing and four gradation printing in the third embodiment are described.

Six Gradation Printing (Cyan and Magenta)

Figure 28A:
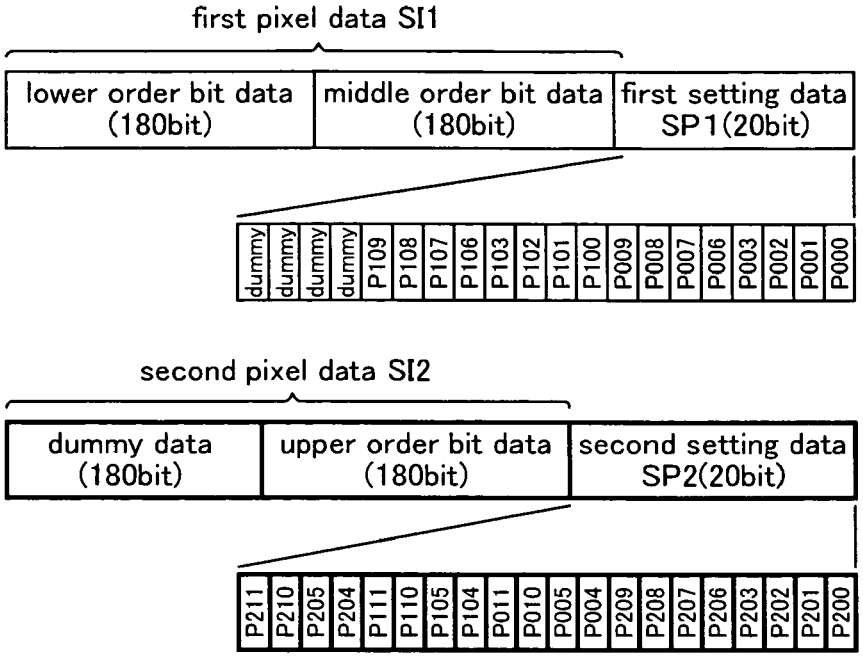
FIG. 28A is an explanatory diagram of the first setting signal that is input to the first input section and the second setting signal that is input to the second input section in the case of six gradation printing.
Figure 28B:
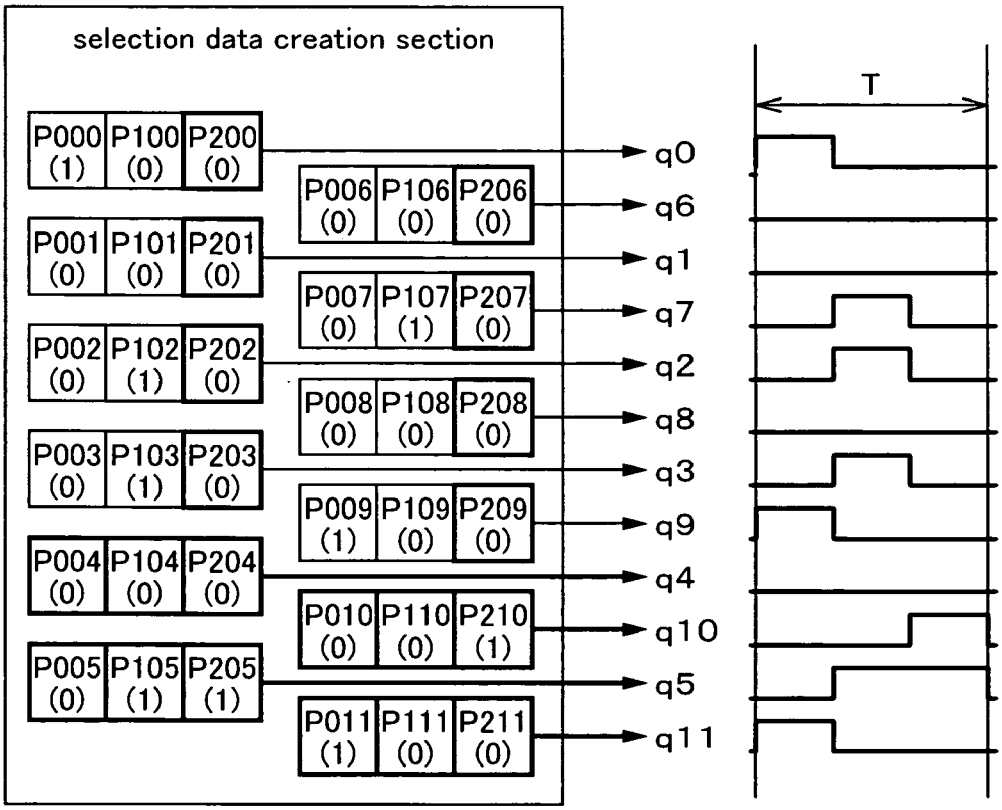
FIG. 28B is an explanatory diagram of the function of the selection signal creation section 844 in the case of six gradation printing.

FIG. 28A is an explanatory diagram of the first setting signal that is input to the first input section 846A and the second setting signal that is input to the second input section 846B at the time of six gradation printing. FIG. 28B is an explanatory diagram of the function of the selection signal creation section 844 at the time of six gradation printing.

The first setting signal includes first pixel data SI1 and first setting data SP1. The first setting data SP1 of the third embodiment are 20 bits of data, including four bits of dummy data. The first setting data SP1 are data for determining whether the selection signals q0 to q3 and the selection signals q6 to q9 are L level or H level in the first interval T21 and the second interval T22. It should be noted that the four bits of dummy data are for matching the data amount of the first setting data SP1 with the data amount of the second setting data SP2.

The second setting signal includes second pixel data SI2 and second setting data SP2. The second setting data SP2 of the third embodiment is made of 20 bits of data. The second setting data SP2 are data for determining whether the selection signals q0 to q3 and the selection signals q6 to q9 are L level or H level in the third interval T23, and data for determining whether the selection signals q4, q5, q10, and q11 are L level or H level in the first interval T21 through the third interval T23.

In the third embodiment, like in the first embodiment and the second embodiment, the first setting signal is input to the first input section 846A and the second setting signal is input to the second input section 846B (see FIG. 27). Thus, the various data are set in the shift registers, and are latched according to the pulse of the latch signal LAT.

The selection signal creation section 844 creates the selection signals q0 to q5 based on the latched setting data and the first change signal CH_A for dividing the repeating period T into three intervals. The selection signal creation section 844 also creates the selection signals q6 to q11 based on the latched setting data and the second change signal CH_B for dividing the repeating period T into three intervals. It should be noted that here, for the sake of simplifying the description, the pulses of the first change signal CH_A and the second change signal CH_B have the same timing, but it is not absolutely necessary for their timings to match. The selection signals q0 to q3 and q6 to q9, like the selection signals q0 to q3 of the second embodiment, are created based on the first setting data SP1 and the second setting data SP2.

For example, the selection signal creation section 844 creates the selection signal q0 based on the data P000, the data P100, and the data P200. It should be noted that the data P000 and the data P100 are data included in the first setting signal, whereas the data P200 are data included in the second setting signal. Similarly, the selection signal creation section 844 creates the selection signals q1 to q3 and q6 to q9 based on two bits of data included in the first setting signal and one bit of data included in the second setting signal.

It should be noted that the selection signals q4, q5, q10, and q11, like the selection signals q4 and q5 of the second embodiment, are created based on predetermined three bits of data included in the second setting signal. For example, the selection signal creation section 844 creates the selection signal q4 based on the data P004, the data P104, and the data P204.

FIG. 29 is a table on the relationship between the 3-bit pixel data and the selection signal that should be selected by the signal selection section.

The signal selection section 83 selects one of the selection signals q0 to q5 and one of the selection signals q6 to q11 in accordance with the three bits of pixel data latched in the first latch circuit 82A through the third latch circuit 82C. The selection signals q0 and q6 are selected if the pixel data are 000, the selection signals q1 and q7 are selected if the pixel data are 001, the selection signals q2 and q8 are selected if the pixel data are 010, the selection signals q3 and q9 are selected if the pixel data are 011, the selection signals q4 and q10 are selected if the pixel data are 100, and the selection signals q5 and q11 are selected if the pixel data are 101. It should be noted that if the upper order bit of the 3-bit pixel data (the pixel data after decoding) is 0, then one of the selection signals q0 to q3 is selected, and one of the selection signals q6 to q9 is selected. If the upper order bit of the 3-bit pixel data (the pixel data after decoding) is 1, then either the selection signal q4 or q5 is selected, and either the selection signal q10 to q11 is selected.

The selection signal that is selected from among the selection signals q0 to q5 is output from the signal selection section 83 as the first switch signal SW_A. The selection signal that is selected from among the selection signals q6 to q11 is output from the signal selection section 83 as the second switch signal SW_B.

The first drive signal COM_A and the first switch signal SW_A are input to the first switch 86A. When the first switch signal SW_A is H level, the first switch 86A becomes on, and the first drive signal COM_A is applied to the piezo element 421. When the first switch signal SW_A is L level, the first switch 86A becomes off and the first drive signal COM_A is not applied to the piezo element 421.

Similarly, the second drive signal COM_B and the second switch signal SW_B are input to the second switch 86B. When the second switch signal SW_B is H level, the second switch 86B becomes on and the second drive signal COM_B is applied to the piezo element 421. When the second switch signal SW_B is L level, the second switch 86B becomes off and the second drive signal COM_B is not applied to the piezo element 421.

If the pixel data before decoding are 000, then the signal selection section 83 selects the selection signals q0 and q6 based on the decoded pixel data of 000, and outputs the selection signal q0 as the first switch signal SW_A and outputs the selection signal q6 as the second switch signal SW_B. The first switch 86A, in accordance with the selection signal q0, which is the first switch signal SW_A, becomes on in the first interval T21 and becomes off in the second interval T22 and the third interval T23. The second switch 86B, in accordance with the selection signal q6, which is the second switch signal SW_B, becomes off in the first interval T21 through the third interval T23. As a result, in the repeating period T2, the first interval signal SS21 is applied to the piezo element 421 and the piezo element 421 is driven by the drive pulse PS21. When the piezo element 421 is driven according to the drive pulse PS21, the ink is subjected to a change in pressure to a degree that does not result in the ejection of ink, and the ink meniscus (the free surface of the ink that is exposed at the nozzle portion) is finely vibrated.

Similarly, if the pixel data before decoding are 001, then a 1.5 pl ink droplet is ejected and a tiny dot is formed, if the pixel data before decoding are 010, then a 3 pl ink droplet is ejected and a small dot is formed, if the pixel data before decoding are 011, then a 7 pl ink droplet is ejected and a medium dot is formed, if the pixel data before decoding are 100, then a 14 pl ink droplet is ejected and a large dot is formed, and if the pixel data before decoding are 101, then a 21 pl ink droplet is ejected and an extra large dot is formed.

Four Gradation Printing (Black and Yellow)

Figure 30A:
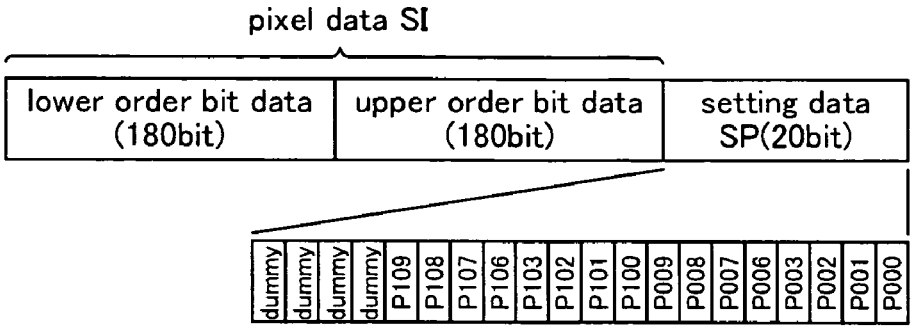
FIG. 30A is an explanatory diagram of the setting signal that is input to the first input section in the case of four gradation printing.
Figure 30B:
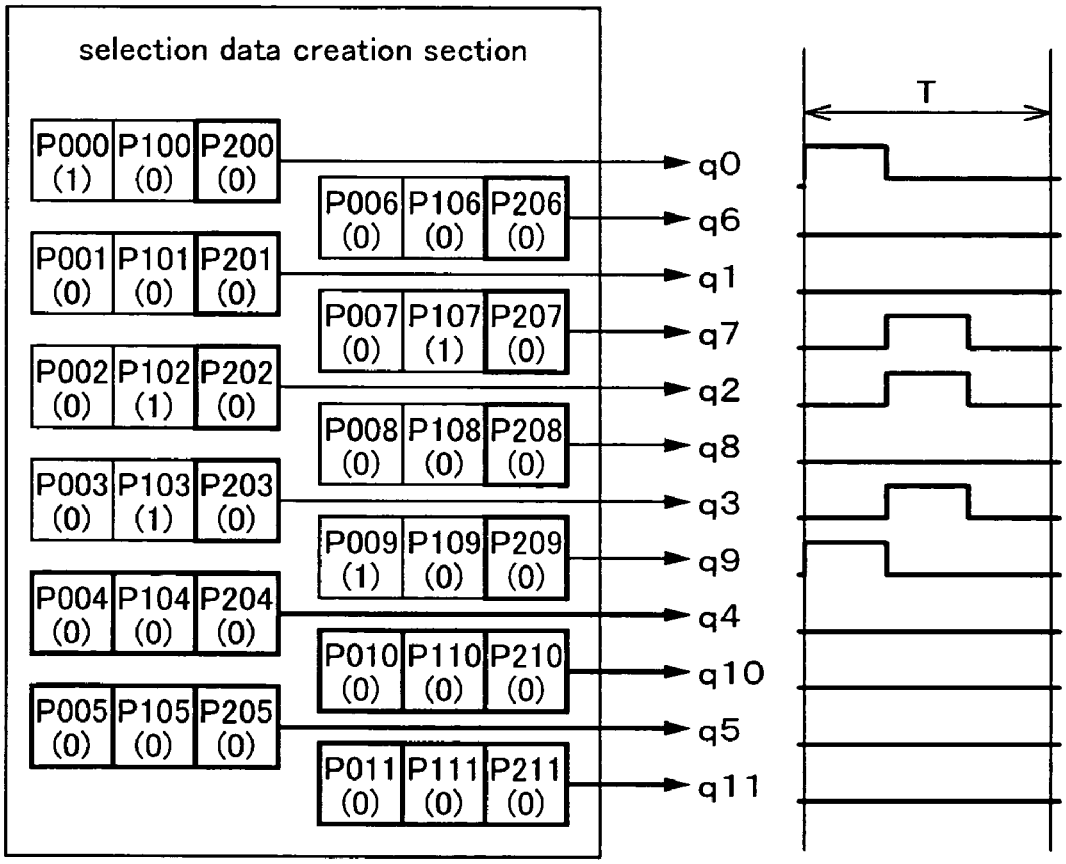
FIG. 30B is an explanatory diagram of the function of the selection signal creation section 844 in the case of four gradation printing.

FIG. 30A is an explanatory diagram of the setting signal that is input to the first input section 846A at the time of four gradation printing. FIG. 30B is an explanatory diagram of the function of the selection signal creation section 844 in the case of four gradation printing.

In the third embodiment, like in the first embodiment and the second embodiment, the second input section 846B of the color head controllers HC that perform four gradation printing is connected to the GND, and the potential of the second input section 846B is L level. Thus, when the setting signal is input to the first input section 846A, L level data is set in the third shift register 81C and the second shift register group 842B. In accordance with the pulse of the latch signal LAT, the L level data that have been set in the third shift registers 81C are latched by the third latch circuits 82C, and the L level data set in the second shift register group 842B are latched by the selection signal creation section 844.

When the selection signal creation section 844 creates the selection signals q0 to q3 and the selection signals q6 to q9, the first interval T21 and the second interval T22 are set to the L level or H level according to the setting data. The selection signal creation section 844 sets the third interval T25 of the selection signals q0 to q3 to the L level in accordance with the L level data from the second shift register group 842B. Thus, the selection signal creation section 844 creates the same selection signals q0 to q3 and selection signals q6 to q9 as in six gradation printing.

The selection signal creation section 844, like in the case of six gradation printing, creates the selection signals q4, q5, q10, and q11 based on the data latched from the second shift register group 842B. However, since the data latched from the second shift register group 842B is L level, the selection signals q4, q5, q10, and q11 are L level in all intervals from the first interval T21 through the third interval T23.

Seen from the signal selection section 83, the data latched by the first latch circuit 82A through the third latch circuit 82C are 3-bit pixel data with upper order bit data of 0. The signal selection section 83 then, like in the case of six gradation printing, selects one of the selection signals q0 to q5, and selects one of the selection signals q6 to q11, according to the three bits of pixel data latched by the first latch circuit 82A through the third latch circuit 82C. However, since the upper order bit data is 0 when seen from the signal selection section 83, none of the selection signals q4, q5, q10, and q11 are selected by the signal selection section 83. Thus, in practical terms the signal selection section 83 selects one of the selection signals q0 to q3 and selects one of the selection signals q6 to q9.

Thus, the ink meniscus is finely vibrated when the pixel data are 00, a 3 pl ink droplet is ejected, forming a small dot, when the pixel data are 01, a 7 pl ink droplet is ejected, forming a medium dot, when the pixel data are 10, and a 14 pl ink droplet is ejected, forming a large dot, when the pixel data are 11.

In this way, with the third embodiment, like in the first embodiment and the second embodiment discussed above, it is possible to use a common head controller HC for four gradation printing and six gradation printing. Also, like in the first embodiment and the second embodiment discussed above, the amount of data of the setting signal that are serially transferred to the first input section 846A and the second input section 846B of the head controller HC is less than in the second reference example, and thus the setting of data is not time consuming.

It should be noted that when the piezo elements 421 are driven using two types of drive signals as in the third embodiment, the two drive signals can be divided into numerous different waveforms and input, and thus the repeating period T2 becomes shorter and the amount of setting data becomes larger because the amount of setting data increases. Regardless, during a given repeating period T2 it is necessary to set the pixel data and the setting data for the next repeating period T2. In the third embodiment, the time required for setting the data can be shortened, and thus during the short repeating period T2 it is possible to set the pixel data and the setting data for the next repeating period T2, and this is particularly effective.

Also, with the third embodiment, the selection signals q0 to q3 and the selection signals q6 to q9 are determined to be L level or H level based on not only the setting data that are input to the first input section 846A but also the signal that is input to the second input section 846B. Thus, the amount of setting data to be input to the first input section 846A can be reduced, and thus; in the third embodiment, the time that is required for setting the data can be shortened even more.

Other Embodiments

The foregoing embodiments are for the purpose of facilitating understanding of the present invention, and are not to be interpreted as limiting the present invention. The invention can of course be altered and improved without departing from the gist thereof and includes functional equivalents. In particular, embodiments mentioned below are also included in the present invention.

Regarding the Printer

In the above embodiments a printer was described, but there is no limitation to this. For example, technology similar to that of the present embodiments can also be adopted for various types of printing apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices.

Regarding the Nozzles

In the foregoing embodiments, ink was ejected using piezoelectric elements. However, the method for ejecting liquid is not limited to this. For example, it is also possible to employ other methods, such as the method of using heaters as the drive elements for ejecting ink.

IN CONCLUSION (1) The head unit 40 discussed above is provided with piezo elements 421 (one example of the drive element) each of which corresponds to a nozzle, and a head controller HC for driving the piezo elements 421 in order to eject an ink droplet (one example of the liquid droplet) from the nozzles. The head controller HC discussed above has a first input section 846A and the second input section 846B.

Then, in the first embodiment, a common head controller HC is used for printing in eight gradations (one example of the first number of gradations) and printing in four gradations (one example of the second number of gradations), and in the second embodiment and the third embodiment, a common head controller HC is used for printing in six gradations (one example of the first number of gradations) and printing in four gradations (one example of the second number of gradations).

In each of these embodiments, when printing is performed at the high number of gradations, the first setting signal is input to the first input section 846A, the second setting signal is input to the second input section 846B, and the piezo elements 421 are driven based on the first setting signal and the second setting signal. In contrast to this, when printing is performed at the low number of gradations, the setting signal is input to the first input section 846A and the second input section 846B is connected to the GND and receives a 0V (one example of the constant potential) signal, and the piezo elements 421 are driven based on the setting signal that has been input to the first input section 846A.

With this head unit, it is possible to use head controllers HC with a common structure to enable printing in different numbers of gradations.

(2) In the embodiments discussed above, the first setting signal and the second setting signal include pixel data. When printing is performed at the high number of gradations, the piezo elements 421 are driven based on the pixel data SI1 included in the first setting signal and the pixel data SI2 included in the second setting signal. In contrast, when performing printing with the low number of gradations, the signal selection section 83 selects the selection signals and the piezo elements 421 are driven based on the pixel data included in the setting signal and the L level set according to the 0V signal.

With this head unit, it is possible to use head controllers HC with a common structure to perform printing with pixel data for a high number of gradations, and to perform printing with pixel data for a low number of gradations.

(3) In the embodiments discussed above, when printing is performed at the high number of gradations, the signal selection section 83 selects the selection signals and the piezo elements 421 are driven based on 3-bit pixel data made of two bits of pixel data included in the first setting signal and one bit of pixel data included in the second setting signal. In contrast, when printing is performed at the low number of gradations, the signal selection section 83 selects the selection signals and the piezo elements 421 are driven based on 3-bit pixel data made of two bits of pixel data included in the setting signal and one bit of data set to the L level.

With this head unit, the signal selection section 83 performs the same operation regardless of the number of gradations, but when a 0V signal has been input to the second input section 846B, printing at the low number of gradations is performed.

(4) The head controller HC discussed above possesses first latch circuits 82A and second latch circuits 82B (one example of the memory portions for first pixel data) that store the pixel data included in the first setting signal, and third latch circuits 82C (one example of the memory section for the second pixel data) that stores the pixel data included in the second setting signal.

Then, the head controller HC drives the piezo elements 421 due to the signal selection section 83 selecting a selection signal based on the pixel data stored in the first latch circuit 82A through the third latch circuit 82C.

With this head unit, the signal selection section 83 performs the same operation regardless of the number of gradations, but when a 0V signal is input to the second input section 846B, printing at the low number of gradations is performed.

(5) In the foregoing embodiments, when a 0V signal is input to the second input section 846B, the pixel data stored in the third latch circuit 82C become L level data. Thus, seen from the signal selection section 83, the data latched by the first latch circuit 82A through the third latch circuit 82C is 3-bit pixel data with an upper order bit of 0. Thus, even if the signal selection section 83 performs the same operation, when the 0V signal is input to the second input section 846B, printing at the low number of gradations is performed.

(6) In the first embodiment and the second embodiment discussed above, the head controller HC has a switch 86. In the third embodiment discussed above, the head controller HC has a first switch 86A and a second switch 86B. Also, the first setting signal and the second setting signal include the first setting data SP1 and the second setting data SP2.

In the case of printing at the high number of gradations, the head controller HC controls the switch based on the first setting data SP1 and the second setting data SP2. In contrast, in the case of printing at the low number of gradations, the head controller HC controls the switch based on the setting data input from the first input section 846A.

With this head unit, head controllers HC with a common structure can be used to carry out printing with setting data for a high number of gradations, as well as to carry out printing with setting data for a low number of gradations.

(7) The head controller HC discussed above has a selection signal creation section 844 that creates a plurality of selection signals. In the case of printing at the high number of gradations, the signal selection section 83 selects a selection signal in accordance with the pixel data included in the first setting signal and the pixel data included in the second setting signal, and the switch is controlled based on the selection signal that has been selected. On the other hand, in the case of printing at the low number of gradations, the signal selection section 83 selects a selection signal according to the pixel data included in the first setting signal and the L level data that have been set due to the 0V signal, and the switch is controlled based on the setting signal that has been selected.

With this head unit, the signal selection section 83 performs the same operation regardless of the number of gradations, but when a 0V signal is input to the second input section 846B, printing at the low number of gradations is performed.

(8) In the first embodiment and the second embodiment discussed above, the head controller HC has a switch 86. In the third embodiment discussed above, the head controller HC has a first switch 86A and a second switch 86B. Also, the first setting signal and the second setting signal include the first setting data SP1 and the second setting data SP2.

In the case of printing at the high number of gradations, the head controller HC controls the switch based on the first setting data SP1 and the second setting data SP2. On the other hand, in the case of printing at the low number of gradations, the head controller HC controls the switch based on the setting data input from the first input section 846A.

With this head unit, head controllers HC with a common structure can be used to carry out printing with setting data for a high number of gradations, as well as to carry out printing with setting data for the low number of gradations.

(9) In the second embodiment and the third embodiment discussed above, when performing printing at the low number of gradations, the selection signals are created based on the setting data SP included in the first setting signal and the L level data set according to the 0V signal. For example, the selection signals q0 to q4 of the second embodiment are determined to be L level or H level in the first interval T11 to the fourth interval T14 based on the setting data SP included in the first setting signal, and are determined to be L level in the fifth interval T15 based on the L level data that have been set according to the 0V signal.

Thus, it is possible to reduce the amount of setting data that is to be input to the first input section 846A.

(10) The head controller HC discussed above has a first shift register group 842A (one example of the memory section for first setting data) and a second shift register 842B (one example of the memory portion for second setting data). The head controller controls the switch based on the setting data stored in the first shift register group 842A and the setting data stored in the second shift register group 842B.

With this head unit, the selection signal creation section 844 performs the same task regardless of the number of gradations, but when a 0V signal is input to the second input section 846B, printing at the low number of gradations is performed.

(11) In the foregoing embodiments, when a 0V signal is input to the second input section 846B, the setting data stored in the second shift register group 842B become L level data. Thus, even though the selection signal creation section 844 performs the same operation, printing at the low number of gradations is performed.

(12) The head controller HC discussed above has a selection signal creation section 844 that creates a plurality of selection signals based on setting data, and controls the switch based on the selection signal that has been selected from among a plurality of selection signals.

(13) Further, in the first embodiment, in the case of four gradation printing, the selection signals q5 to q7, which are created based on the L level data set according to the signal of the constant potential, are not selected. Thus, even though the selection signal creation section 844 performs the same operation regardless of the number of gradations, printing at the low number of gradations is performed when a 0V signal is input to the second input section 846B.

It should be noted that in the second embodiment as well, in the case of four gradation printing, the selection signals q4 and q5, which are created based on the L level data set according to the signal of the constant potential, are not selected. Similarly, in the third embodiment as well, in the case of four gradation printing, the selection signals q4, q5, q10, and q11, which are created based on the L level data set according to the signal of the constant potential, are not selected.

(14) As described previously, the first setting signal and the second setting signal include pixel data. In the case of printing at the high gradation number, the head controller HC controls the switch based on the selection signal that is selected according to the pixel data included in the first setting signal and the second setting signal. On the other hand, in the case of printing at the low gradation number, the head controller HC controls the switch based on the selection signal that is selected according to the pixel data included in the first setting signal, and the L level data that have been set according to the 0V signal.

With this head unit, the signal selection section 83 performs the same operation regardless of the number of gradations, but when the 0V signal is input to the second input section 846B, printing at the low number of gradations is performed.

(15) In the foregoing embodiments, the drive signal COM is a signal that is repeated in a predetermined repeating period. In this repeating period, the drive signal COM includes a plurality of drive pulses for driving the drive elements. The setting data discussed above are data for controlling whether the switch is on or off in each interval of the repeating period, that is to say, the setting data are data for determining whether or not the various drive pulses are to be applied to the piezo elements 421.

(16) In the first embodiment and the second embodiment, there is a single type of drive signal COM. However, it is also possible to use two types of drive signals as in the third embodiment, and additionally it is also possible to use three or more drive signals.

(17) In the foregoing embodiments, while the piezo elements 421 are driven in a given repeating period, the data necessary for driving the piezo elements 421 in the next repeating period are set to the head controller HC.

For this reason, there is a problem that it is time consuming to set the data when the amount of data to be set is large, but since the amount of data to be set is reduced in the foregoing embodiments, it is possible to complete the setting of data necessary for the next repeating period during a given repeating period, even though the repeating period is short, for example.

(18) In the foregoing embodiments, the second input section 846B is connected to the GND. However, this is not a limitation. For example, it is also possible to connect the second input section 846B to a power source for driving the head controller HC.

(19) The printer of the foregoing embodiments (one example of the printing apparatus) is provided with at least two head controllers HC. A given head controller HC is used to perform printing at the high number of gradations and a separate head controller HC is used to perform printing at the low number of gradations.

(20) It should go without saying that the foregoing embodiments disclose not only implementations of a printer but also disclose printing methods.

What is claimed is:

1. A printing method comprising:

preparing a drive element that corresponds to a nozzle, and a controller that drives the drive element so as to eject a liquid droplet from the nozzle, the controller having a first input section and a second input section;

in the case of printing with a first number of gradations, driving the drive element based on a first signal and a second signal, by inputting the first signal to the first input section and inputting the second signal to the second input section; and in the case of printing with a second number of gradations that is lower than the first number of gradations, driving the drive element based on a first signal, by inputting the first signal to the first input section and inputting a signal of a constant potential to the second input section.

2. A printing method according to claim 1, wherein pixel data that corresponds to a pixel is included in the first signal and the second signal, wherein in the case of printing with the first number of gradations, the controller drives the drive element, based on the pixel data included in the first signal and the pixel data included in the second signal, and wherein in the case of printing with the second number of gradations, the controller drives the drive element, based on the pixel data included in the first signal and data that has been set according to the signal of the constant potential.

3. A printing method according to claim 2, wherein in the case of printing with the first number of gradations, the controller drives the drive element, based on i+j bit of pixel data formed of i bit of the pixel data included in the first signal and j bit of the pixel data included in the second signal, and wherein in the case of printing with the second number of gradations, the controller drives the drive element, based on i+j bit of pixel data formed of i bit of the pixel data included in the first signal and j bit of data that has been set at a specific value according to the signal at the constant potential.

4. A printing method according to claim 2, wherein the controller includes a first pixel data storage section that stores the pixel data included in the first signal, and a second pixel data storage section that stores the pixel data included in the second signal, and wherein the controller drives the drive element, based on the pixel data stored in the first pixel data storage section and the pixel data stored in the second pixel data storage section.

5. A printing method according to claim 4, wherein when the signal of the constant potential is input to the second input section, the pixel data to be stored in the second pixel data storage section becomes a specific value.

6. A printing method according to claim 2, wherein the controller has a switch that controls whether or not to apply a drive signal to the drive element, wherein setting data for setting control of the switch is included in the first signal and the second signal, and wherein in the case of printing with the first number of gradations, the controller controls the switch, based on the setting data included in the first signal and the setting data included in the second signal, and wherein in the case of printing with the second number of gradations, the controller controls the switch, based on the setting data included in the first signal.

7. A printing method according to claim 6, wherein the controller has a selection signal creation section that creates a plurality of selection signals, wherein in the case of printing with the first number of gradations, the controller controls the switch based on a selection signal that has been selected according to the pixel data included in the first signal and the pixel data included in the second signal, from among a plurality of the selection signals, and wherein in the case of printing with the second number of gradations, the controller controls the switch based on a selection signal that has been selected according to the pixel data included in the first signal and data that has been set according to the signal of the constant potential, from among a plurality of the selection signals.

8. A printing method according to claim 2, wherein the controller has a switch that controls whether or not to apply a drive signal to the drive element, wherein setting data for setting control of the switch is included in the first signal and the second signal, wherein in the case of printing with the first number of gradations, the controller controls the switch, based on the setting data included in the first signal and the setting data included in the second signal, and wherein in the case of printing with the second number of gradations, the controller controls the switch, based on the setting data included in the first signal.

9. A printing method according to claim 8, wherein in the case of printing with the second number of gradations, the controller controls the switch, based on the setting data included in the first signal and data that has been set according to the signal of the constant potential.

10. A printing method according to claim 8, wherein the controller has a first setting data storage section that stores the setting data included in the first signal, and a second setting data storage section that stores the setting data included in the second signal, and wherein the controller controls the switch, based on the setting data that is stored in the first setting data storage section and the setting data that is stored in the second setting data storage section.

11. A printing method according to claim 10, wherein when the signal of the constant potential is input to the second input portion, the setting data that is to be stored in the second setting data storage section becomes a specific value.

12. A printing method according to claim 8, wherein the controller has a selection signal creation section that creates a plurality of selection signals based on the setting data, and controls the switch based on the selection signal that has been selected from a plurality of the selection signals.

13. A printing method according to claim 12, wherein in the case of printing with the second number of gradations, a selection signal that has been created based on data that has been set according to the signal of the constant potential is not selected.

14. A printing method according to claim 12, wherein the pixel data that corresponds to a pixel is included in the first signal and the second signal, wherein in the case of printing with the first number of gradations, the controller controls the switch based on the selection signal that has been selected according to the pixel data included in the first signal and the pixel data included in the second signal, and wherein in the case of printing with the second number of gradations, the controller controls the switch based on the selected signal that has been selected according to the pixel data included in the first signal and data that has been set according to the signal of the constant potential.

15. A printing method according to claim 8, wherein the drive signal is a signal that is repeated in a predetermined period, wherein a plurality of drive pulses for driving the drive element are included in the predetermined period of the drive signal, and wherein the setting data is data for determining whether or not to apply each drive pulse to the drive element.

16. A printing method according to claim 15, wherein the controller applies to the drive element the drive pulses included in any drive signal of a plurality of types of drive signals, and wherein the setting data is data for determining whether or not to apply each drive pulse of each drive signal to the drive element.

17. A printing method according to claim 1, wherein while the drive element is being driven during a certain period, a signal necessary for driving the drive element in the next period is input to the first input section and the second input section.

18. A printing method according to claim 1, wherein the second input section is connected to the GND.

19. A printing apparatus comprising:

a drive element that corresponds to a nozzle;

a first controller that drives the drive element so as to eject a liquid droplet from the nozzle; and a second controller that drives the drive element so as to eject a liquid droplet from the nozzle, wherein the first controller and the second controller have a first input section and a second input section, respectively, wherein with the first controller that prints with a first number of gradations, a first signal is input to the first input section and a second signal is input to the second input section, and the drive element is driven based on the first signal and the second signal, and wherein with the second controller that prints with a second number of gradations that is lower than the first number of gradations, the first signal is input to the first input section and a signal of a constant potential is input to the second input section, and the drive element is driven based on the first signal.

20. A head unit comprising:

a drive element that corresponds to a nozzle; and a controller that drives the drive element so as to eject a liquid droplet from the nozzle, wherein the controller has a first input section and a second input section, wherein in the case of printing with a first number of gradations, a first signal is input to the first input section and a second signal is input to the second input section, and the drive element is driven based on the first signal and the second signal, and wherein in the case of printing with a second number of gradations that is lower than the first number of gradations, a first signal is input to the first input section and a signal of a constant potential is input to the second input section, and the drive element is driven based on the first signal.

* * * * *